US007973747B2

(12) United States Patent
Ono et al.

(10) Patent No.: US 7,973,747 B2
(45) Date of Patent: Jul. 5, 2011

(54) DISPLAY AND DISPLAY DRIVING METHOD

(75) Inventors: Masayuki Ono, Osaka (JP); Shogo Nasu, Hyogo (JP); Toshiyuki Aoyama, Osaka (JP); Masaru Odagiri, Hyogo (JP)

(73) Assignee: Panasonic Corporation, Osaka (JP)

( * ) Notice: Subject to any disclaimer, the term of this patent is extended or adjusted under 35 U.S.C. 154(b) by 765 days.

(21) Appl. No.: 11/665,567

(22) PCT Filed: Oct. 25, 2005

(86) PCT No.: PCT/JP2005/019587
§ 371 (c)(1),
(2), (4) Date: Apr. 17, 2007

(87) PCT Pub. No.: WO2006/046553
PCT Pub. Date: May 4, 2006

(65) Prior Publication Data

US 2009/0046043 A1 Feb. 19, 2009

(30) Foreign Application Priority Data

Oct. 28, 2004 (JP) ..... 2004-313858

(51) Int. Cl.
*G09G 3/30* (2006.01)

(52) U.S. Cl. ..... 345/79; 345/77; 345/78

(58) Field of Classification Search ..... 345/60–79
See application file for complete search history.

(56) References Cited

U.S. PATENT DOCUMENTS 4,301,451 A * 11/1981 Barta ..... 345/79
4,488,150 A 12/1984 Kanatani
5,311,169 A 5/1994 Inada et al.
5,384,456 A 1/1995 Saika et al.
5,486,738 A 1/1996 Saika et al.
(Continued)

FOREIGN PATENT DOCUMENTS

JP 52-33491 3/1977
(Continued)

OTHER PUBLICATIONS

International Preliminary Report on Patentability and Written Opinion of the International Searching Authority, issued in corresponding International Patent Application No. PCT/JP2005/019587, dated on Oct. 25, 2005.

*Primary Examiner* — Alexander Eisen
*Assistant Examiner* — Christopher E Leiby
(74) *Attorney, Agent, or Firm* — McDermott Will & Emery LLP

(57) ABSTRACT

There is provided a display device: a display unit including a plurality of scan electrodes arranged to extend in parallel to each other along a first direction, a plurality of data electrodes arranged to extend in parallel to each other along a second direction crossing the scan electrodes, and a plurality of pixels, each pixel at which a pair of the scan electrode and the data electrode cross each other, each pixel having a light emitting layer and a dielectric layer interposed between the scan electrode and the data electrode from a direction vertical to a face; and an erasing pulse supplying unit operable to supply attenuation voltage pulse, to the light emitting layer of each pixel, which starts at a voltage not more than an emission starting voltage at which the light emitting layer starts emission and in which polarity is alternately reversed between positive and negative.

20 Claims, 15 Drawing Sheets

U.S. PATENT DOCUMENTS

| | | | | |
|---|---|---|---|---|
| 5,541,618 | A | 7/1996 | Shinoda | |
| 5,666,305 | A * | 9/1997 | Mihara et al. | 365/145 |
| 5,703,666 | A | 12/1997 | Saika et al. | |
| 7,286,102 | B2 * | 10/2007 | Yoon et al. | 345/60 |
| 2005/0073477 | A1 * | 4/2005 | Yoo | 345/60 |

FOREIGN PATENT DOCUMENTS

| | | |
|---|---|---|
| JP | 54-41175 | 12/1979 |
| JP | 61-230296 | 10/1986 |
| JP | 61230296 | 10/1986 |
| JP | 63-15590 | 4/1988 |
| JP | 1-307797 | 12/1989 |
| JP | 3-69990 | 3/1991 |
| JP | 4-195188 | 7/1992 |
| JP | 5-35207 | 2/1993 |
| JP | 5-257430 | 10/1993 |
| JP | 7-044072 | 5/1995 |
| JP | 7-044072 B | 5/1995 |
| JP | 9-22780 | 1/1997 |
| JP | 9-160522 | 6/1997 |
| JP | 11-224776 | 8/1999 |
| JP | 2003-157972 | 5/2003 |

* cited by examiner

DISPLAY AND DISPLAY DRIVING METHOD

RELATED APPLICATIONS

This application is the U.S. National Phase under 35 U.S.C. §371 of International Application No. PCT/JP2005/019587, filed on Oct. 25, 2005, which in turn claims the benefit of Japanese Application No. 2004-313858, filed on Oct. 28, 2004, the disclosures of which Applications are incorporated by reference herein.

TECHNICAL FIELD

The present invention relates to a display device using capacitive light emitting elements having dielectric layers, and in particular, to a display device performing electroluminescence (hereinafter abbreviated as EL) emission, and a driving method thereof.

BACKGROUND ART

Recently, there are large expectations for EL elements in the field of a flat-type display device. An EL element is characterized as to have a self-luminous property, a high level of visibility, a wide viewing angle, a fast response and the like. EL elements currently developed include an inorganic EL element using an inorganic material as a light emitting material and an organic EL element using an organic material as a light emitting material.

In an inorganic EL element in which an inorganic phosphor such as zinc sulfide is used as a light emitting material, electrons accelerated in a high electric field of $10^6$V/cm collision-excites the light emitting center of the phosphor, and when they are relieved, light is emitted. Inorganic EL elements includes a dispersion EL element having such a structure that phosphor powder is dispersed in polymeric organic materials and electrodes are provided on top and bottom, and a thin-film EL element having two dielectric layers between a pair of electrodes and a thin film light emitting layer interposed between the dielectric layers. A dispersion EL element is easily manufactured, but the brightness is low and the service life is short, so it has been used only for limited purposes. On the other hand, as for a thin film EL element, an element having a dual insulating structure proposed by Inoguchi et al. in 1974 (see, for example, Japanese Patent Laid-open Publication No. 52-33491) shows high brightness and a long service life, which has been used practically for an in-car display or the like.

Here, a typical configuration of the thin film EL element will be explained by using FIG. 12. FIG. 12 is a sectional view vertical to a light emitting face of a thin film EL element 60. The EL element 60 has such a configuration that a transparent electrode 62, a first dielectric layer 63, a light emitting layer 64, a second dielectric layer 65, and a counter electrode 66 are laminated in this order on a transparent substrate 61. By applying alternating voltage between the transparent electrode 62 and the counter electrode 66, light is emitted from the light emitting layer 64. The first dielectric layer 63 and the second dielectric layer 65 interposing the light emitting layer 64 have a function of limiting current flowing through the light emitting layer 64, are capable of suppressing dielectric breakdown of the EL element 60, and act so as to obtain stable light emitting characteristics. Light emitted from the light emitting layer 64 is taken out from the transparent electrode 62 side.

Further, a display device may be configured by aligning a plurality of EL elements two-dimensionally in such a manner that the transparent electrode 62 is shared by a plurality of EL elements in the same row, and the counter electrode 65 is shared by a plurality of EL elements in the same row. In such a case, one transparent electrode extends in a row direction, and a plurality of transparent electrodes, parallel to each other, and a plurality of counter electrodes are stripe patterned so as to be made orthogonal to each other, and by applying a voltage to specific pixels selected by a matrix, it is possible to obtain a passive matrix driving type display device which performs any pattern display.

A basic driving method of a display device using the above-described EL element is realized such that transparent electrodes of the EL elements are used as data electrodes and counter electrodes are used as scan electrodes, and modulation voltage corresponding to display data determining whether to emit light or not is applied to the data electrodes while writing voltage is applied to the scan electrodes in a linear order. In this driving method, a superposed effect or an offset effect of writing voltage and modulation voltage is generated at parts where the scan electrodes and the data electrodes cross to each other (hereinafter referred to as pixels for short) in the EL element. The EL element has a voltage-brightness characteristic as shown in FIG. 13, and as an emission starting voltage $V_{th}$ (hereinafter $V_{th}$ indicates a positive real number), a high voltage as much as about 200V is required generally. In each pixel, when a voltage of not less than the emission starting voltage $V_{th}$ is applied, light is emitted, and when a voltage of not more than the emission starting voltage $V_{th}$ is applied, a state where light is not emitted is shown, whereby a desired display is obtained as a whole.

In a display device using such thin film EL elements, as a driving method for realizing gradation display of each pixel, there is known a voltage modulation method in which control is performed with voltage pulse amplitude applied to EL elements (see, for example, Japanese Patent Laid-open Publication No. 63-15590) or a pulse width modulation method in which control is performed with a pulse width (see, for example, Japanese Patent Laid-open Publication No. 01-307797). Among them, the voltage modulation method is capable of realizing a medium brightness by applying amplitude of modulation voltage applied to data electrodes in a multistage manner, but has a problem that gradation control accuracy is extremely low due to precipitous property and nonlinearity of voltage-brightness characteristics and hysteresis characteristics. On the other hand, the pulse width modulation method is capable of realizing a medium brightness by controlling the pulse width of modulation voltage applied to the data electrode in a multistage manner theoretically, but when driving pulse in a rectangle waveform is applied to the EL element, current contributing to light emission rises with a precipitous peak immediately after a rise of the voltage, and then shows a behavior of being attenuated rapidly as the same as charge current to the capacitor. The period in which the current flows is a short period of several μ seconds, and even though the pulse width is extended after the current is attenuated, current will not flow any more, so a brightness difference corresponding to the pulse width cannot be obtained. In order to obtain a sufficient gradation display by controlling the pulse width, it is required to control a multistage pulse width within the period of several μ seconds during which the current flows. However, if the pulse width varies slightly due to the response velocity of a driving circuit or the control accuracy of the pulse width or the like, the brightness largely changes. Therefore, gradation control by the pulse width modulation method is not suitable for EL elements.

Consideration will be given for the reason why the current contributing to light emission in an EL element rises with a precipitous peak immediately after a rise of voltage and then behaves to be attenuated rapidly as described above. One reason may be a fact that the EL element is a capacitive element. That is, the EL element has such a structure that the light emitting layer 64 is interposed between the dielectric layers 63 and 65, so it may be seen as a capacitive element from a viewpoint of equivalent circuit. In this case, when voltage pulse not less than an emission starting voltage is applied to the light emitting layer 64, the resistance of the light emitting layer 64 falls rapidly and electrons pass through the light emitting layer 64 in the high electric field to thereby excite the light emitting center, and then they reach the interface with the dielectric layer 65 and are retained. In this way, after light emitting operation is carried out, polarization charges remain in the light emitting layer. Hereinafter, this polarization charges are referred to as "first polarization charges" for short, and the potential difference caused inside the light emitting layer by the first polarization charges is referred to as a "first polarization voltage" for short. With the first polarization charges, a potential difference acting in a reverse direction to the outside voltage is caused inside the light emitting layer 64, whereby an effective voltage acted on the light emitting layer 64 becomes smaller than the emission starting voltage $V_{th}$ due to an offset with the outside applied voltage, so current will not flow any more. Therefore, when voltage pulse is applied to an EL element, current contributing to light emission rises with a precipitous peak immediately after a rise of voltage, and then is attenuated rapidly.

This phenomenon will be explained in more detail by using FIG. 14, in which the horizontal axis shows the applied voltage V and the vertical axis shows the first polarization charges P. When voltage is not applied to an EL element and the first polarization charges do not exist in the light emitting layer, it is in a state of position A (polarization amount 0) in the Figure. Then, when a driving voltage $V_r$ (voltage higher than emission starting voltage) in a pulse shape is applied so as to cause the EL element to emit light, it is transferred to a state of position B (polarization amount $P_b$) in the Figure as the applied voltage V rises, and then, even when the applied voltage V becomes 0, it is transferred not to a state of the first position A (polarization amount 0) but to a state of position C (polarization amount $P_c$). Namely, the first polarization charges remain in the light emitting layer even though voltage is not applied. This is considered as being based on a fact that when a voltage not less than the emission starting voltage is applied to the light emitting layer, electrons discharged from the proximity of the interface of one dielectric layer pass through the light emitting layer and reach the interface of the other dielectric layer, and are captured in a deep trap near the interface. Between the captured electrons and positive spatial charges in the light emitting layer, a steady electric field is formed and maintained. Then, when the polarity of the applied voltage between electrodes are reversed and a driving voltage $-V_r$ in a pulse shape like the above-described one is applied, it is transferred from a state of position C (polarity amount $P_c$) via a state of position D (polarity amount 0) along the oblique line of negative voltage application to a state of position E (polarization amount $P_e$). Then, when the applied voltage becomes 0, it is transferred to a state of position F. In the state of position F, negative first polarization charges (polarization amount $P_f$) remain.

As described above, if a state where the first polarization charges remain in the light emitting layer continues, the first polarization voltage caused by the first polarization charges will be applied to the inside of the light emitting layer. Then, when light is emitted next time, the first polarization voltage is superposed with the outside applied voltage and applied to the light emitting layer. Therefore, although a voltage not more than the emission starting voltage $V_{th}$, providing operation of not emitting light, is applied, an effective voltage exceeding the emission starting voltage $V_{th}$ is applied to the light emitting layer due to the first polarization voltage, which may cause false light emission.

Conventionally, in order to prevent such a false light emission at the time of next light emission, there has been proposed a method in which after a writing voltage is applied to each field, a polarization correction voltage of reversed polarization with respect to that of the writing voltage is applied so as to erase the first polarization charges (see, for example, Japanese Patent Laid-open Publication No. 03-69990). FIG. 15 is a time chart of a voltage applied to a light emitting layer of each pixel, showing an exemplary driving method for applying a polarization correction voltage. In a writing period 71, selective light emission is performed for each scan line, and then in a polarization erasing period 72, a polarization correction voltage of reverse polarity with respect to that of the writing voltage is applied. Further, $C_{11}$ and $C_{12}$ in FIG. 15 show pixels of different scan electrodes. In the Figure, an outside voltage applied to a pixel is shown by a continuous line, and the first polarization voltage caused by the remaining first polarization charges in the light emitting layer is shown by a broken line. In this conventional example, after a voltage not less than the emission starting voltage $V_{th}$ is applied as a writing voltage in a linear order so as to perform light emission displaying, a polarization correction voltage near the emission starting voltage $V_{th}$ is applied to all pixels. By applying the writing voltage, each pixel emits light, and then the first polarization voltage of reverse polarity with respect to that of the writing voltage is caused by the first polarization charges in the light emitting layer due to the first polarization charges remain in the light emitting layer. Then, when the polarization correction voltage is applied, a voltage in which the first polarization voltage and the polarization correction voltage are superposed is applied to the light emitting layer, and when the value of this voltage becomes the emission starting voltage $V_{th}$ or more, the pixel emits light. After the emission, the first polarization voltage of reverse polarity with respect to that of the polarization correction voltage is applied to the light emitting layer, but the polarization correction voltage is so set as to be smaller than the first polarization voltage after the writing voltage is applied.

On the other hand, a conventional thin film EL element as shown in FIG. 12 does not have brightness sufficient for a high definition display such as a television, in general. Here, the relationship between an outside voltage applied to an EL element and a voltage allocated to a light emitting layer will be explained. Assuming that an outside voltage applied to an EL element is V', the relative dielectric constant of a dielectric layer is $\epsilon i$, the film thickness is di, the relative dielectric constant of a light emitting layer is $\epsilon p$, and the film thickness is dp, the voltage V allocated to the light emitting layer is given by the following equation (1).

$$V=\epsilon i\cdot dp/(\epsilon i\cdot dp+\epsilon p\cdot di)\cdot V' \quad (1)$$

As obvious from the equation (1), in order to allocate a voltage effectively to a light emitting layer, it is desirable to make it to be a thin film by using a material having a large relative dielectric constant of a dielectric layer. For improving brightness of an EL element, Japanese Patent Publication No. 07-44072, for example, proposes an EI element in which an insulating ceramic substrate is used as a substrate and one dielectric layer constituting a dual insulating structure is a thick film dielectric layer. In the thick film dielectric layer, fine particles of a dielectric material having the perovskite structure such as $BaTiO_3$, $SrTiO_3$, $PbTiO_3$, $CaTiO_3$, $Sr(Zr, Ti)O_3$, $Pb(Zr, Ti)O_3$ are dispersed in an organic polymer matrix and made into paste, and then deposited by using a printing method, and then processed by heat treatment at high temperature whereby a large relative dielectric constant is realized. In general, a ferroelectric having the perovskite structure has large relative dielectric constant, which is preferable for making an EL element to have high brightness.

SUMMARY OF THE INVENTION

However, the present inventor found that in the conventional examples described above, first polarization charges were not solved sufficiently and were distributed nonuniformly and remained, due to the characteristics of EL element, manufacturing variations in the deposition process and the like.

This phenomenon will be explained by using FIG. 15. Generally, the first polarization voltage after light emission by applying a writing voltage causes variations in respective pixels due to the characteristics of an EL element and manufacturing variations in the deposition process. Therefore, considering a pixel $C_{11}$ and a pixel $C_{12}$ as a pixel ($C_{11}$) having the smallest absolute value of the first polarization voltage caused by the first polarization charges remaining after light emission in the same display device, and a pixel ($C_{12}$) having the largest absolute value, respectively. The first polarization voltages of the pixel $C_{11}$ and the pixel $C_{12}$ are set to $-V_{PMIN}$ and $-V_{PMAX}$, respectively.

Further, for the polarization correction voltage, almost the same value is applied to almost all pixels. Therefore, assuming that the polarization correction voltage value is $-V_{EP}$, differential voltages of $V_{PMIN}-(-V_{EP})$ and $V_{PMAX}-(-V_{EP})$ are applied to light emitting layers of the pixel $C_{11}$ and the pixel $C_{12}$, respectively. Here, in order to perform polarization correction for all pixels, at least $V_{PMIN}+V_{EP}>V_{th}$ must be satisfied. By setting the smallest possible $V_{EP}$ satisfying this relationship, the pixel $C_{11}$ emits light slightly, and the first polarization voltage thereafter can be made to a very small one. However, even in this case, a voltage larger by the difference between $V_{PMIN}$ and $V_{PMAX}$ is applied to the pixel $C_{12}$, and after light emission, the first polarization voltage larger than the pixel $C_{11}$ remains.

Further, the value of $V_{PMIN}$ varies depending on display devices, so in order to perform polarization correction securely for all pixels in all display devices, $V_{EP}$ must be set as close as $V_{th}$. When $V_{EP}$ is set large as described above, the applied voltage at the time of polarization correction becomes large, so the first polarization voltage thereafter also becomes large.

Note that if $V_{EP}$ is set too small in order to make the first polarization voltage after polarization correction in the pixel $C_{12}$ small, there may be a case where $V_{PMIN}+V_{EP}>V_{th}$ is not satisfied in the pixel $C_{11}$. In such a case, light is not emitted in the pixel $C_{11}$ by being applied with a polarization correction voltage, so the first polarization voltage $V_{PMIN}$ remains as it is.

In the state where the first polarization charges remain inside the light emitting layer of an EL element as described above, the first polarization voltage caused by the first polarization charges is superposed with the outside voltage applied at the next light emission, which may exceeds the emission starting voltage $V_{th}$ so as to cause false light emission. In addition, as a display device has larger screen and becomes higher definition, the emission starting voltage $V_{th}$ involves minute fluctuations due to characteristic variations of the EL element of each pixel actually, whereby it is difficult to realize gradation displaying with voltage control.

Further, in the case where a ferroelectric material having a large relative dielectric constant is used as a dielectric layer in order to improve brightness, there was found a problem that polarization charges remain inside a light emitting layer due to inside charges of a dielectric layer as described below. A ferroelectric has spontaneous polarization in which polarization reversal is possible by applying electric field, so when voltage pulse is applied from the outside, remaining charges are formed in the interface between the light emitting layer and the dielectric layer even after the applied voltage becomes 0, due to the spontaneous polarization. The polarization charges remain inside the light emitting layer due to the remaining charges. Hereinafter, the polarization charges are referred to as "second polarization charges" for short, and a potential difference caused inside the light emitting layer due to the second polarization charges is referred to as a "second polarization voltage" for short.

In other words, two kinds of polarization charges, that is, the first polarization charges caused by a fact that electrons moving inside a light emitting layer due to light emission are captured in a deep trap near the interface between the light emitting layer and a dielectric layer, and the second polarization charges caused by the spontaneous polarization by the ferroelectrics, are superposed and remain in the light emitting layer. Hereinafter, those in which the first polarization charges and the second polarization charges are combined are referred to as "polarization charges" for short, and potential difference caused inside the light emitting layer by the polarization charges is referred to as a "polarization voltage" for short.

An object of the present invention is to securely erase polarization charges remaining in a light emitting layer through a series of control sequence so as to stabilize an effective voltage level applied to an EL element at the next light emission. An additional object of the present invention is to provide a method of driving a high definition display device and a display device in which an effective voltage level applied to an EL element at the next light emission is stabilized and also a multi-gradation control is realized, as a series of control sequence. Further, still additional object of the present invention is to provide a display device of a passive matrix driving method using EL elements, which can realize sufficient brightness as a high definition display such as a television even though the number of scan lines increases corresponding to the development of high resolution.

One of the above-mentioned objects is achieved by the following display device. A display device including:

- a display unit having:
  - a plurality of scan electrodes extending along a first direction and arranged parallel to each other;
  - a plurality of data electrodes extending along a second direction crossing the scan electrodes and arranged parallel to each other; and
  - a plurality of pixels, each pixel at which a pair of the scan electrode and the data electrode cross each other, each pixel having a light emitting layer and a dielectric layer interposed between the scan electrode and the data electrode from a direction vertical to a face; and
- an erasing pulse supplying unit operable to supply an attenuation voltage pulse, to the light emitting layer of each pixel, wherein the attenuation voltage pulse starts at a voltage not more than emission starting voltage at which the light emitting layer starts emission, and wherein polarity of the attenuation voltage pulse is alternately reversed between positive and negative.

One of the above-mentioned objects is achieved by the following driving method. In a method of driving a display device, the display device includes, a display unit having a plurality of scan electrodes extending along a first direction and arranged parallel to each other, a plurality of data electrodes extending along a second direction crossing the scan electrodes and arranged parallel to each other, and a plurality of pixels, each pixel at which a pair of the scan electrode and the data electrode cross each other, each pixel having a light emitting layer and a dielectric layer interposed between the scan electrode and the data electrode from a direction vertical to a face. The method includes an erasing step for applying an attenuation voltage pulse, to the light emitting layer of each pixel, wherein the attenuation voltage pulse starts at a voltage not more than emission starting voltage at which the light emitting layer starts light emission, and wherein polarity of the attenuation voltage pulse is alternately reversed between positive and negative.

According to the display device of the present invention, it is possible to effectively erase polarization charges accumulated in a light emitting layer by applying attenuation voltage pulse, in which the polarity is alternately reversed between positive and negative, to each pixel. Thereby, it is possible to stabilize the effective voltage level applied to the EL element at the time of next emission. Further, according to the method of driving a display device of the present invention, it is possible to easily provide a high definition display device capable of performing multi-gradation displaying with high brightness by using a subfield driving method including an erasing step for applying an attenuation voltage pulse, in which the polarity is alternately reversed between positive and negative, to each pixel, as a series of control sequence.

BRIEF DESCRIPTION OF THE DRAWINGS

The present invention will become readily understood from the following description of preferred embodiments thereof made with reference to the accompanying drawings, in which like parts are designated by like reference numeral and in which.

DESCRIPTION OF REFERENCE NUMERALS

Figure 1:
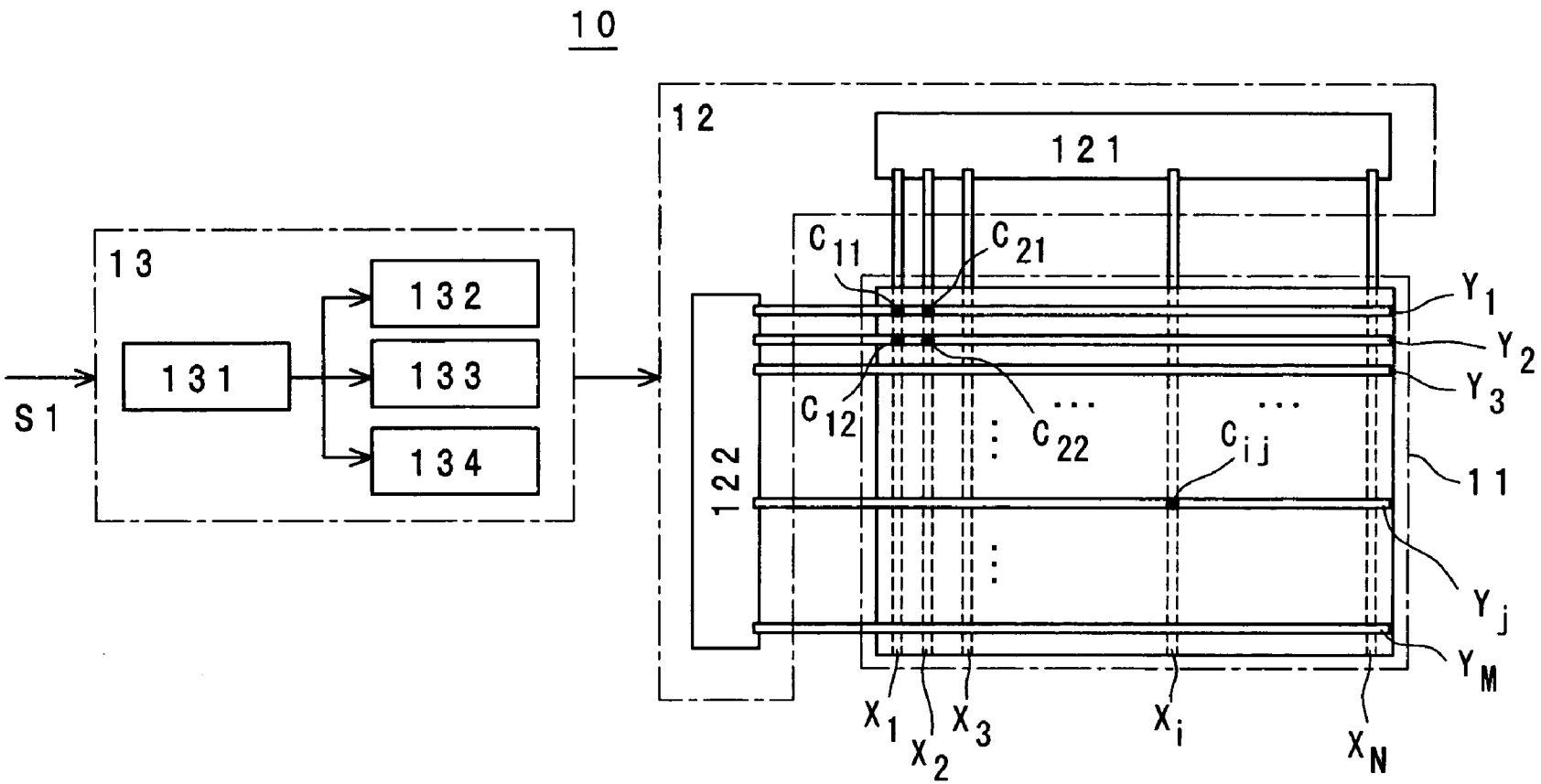
FIG. 1 is a block diagram showing the configuration of a display device according to an embodiment 1 of the present invention.

10 display device, 11 display unit, 12 driving unit, 13 controller, 14 substrate, 15 first dielectric layer, 16 light emitting layer, 17 second dielectric layer, 121 data electrode driving circuit, 122 scan electrode driving circuit, 133 subfield dividing unit, 132 writing pulse supplying unit, 133 maintaining pulse supplying unit, 134 erasing pulse supplying unit, 20, 1 subfield, 21 writing period, 22 maintaining period, 23 erasing period, 30 1 field, 31-38 subfield, 31*a*-38*a* writing period, 31*b*-38*b* maintaining period, 31*c*-38*c* erasing period, 40 1 field, 41-48 subfield, 41*a*-48*a* writing period, 42*b*-48*b* maintaining period, 41*c*-48*c* erasing period, 50 display device, 51 display unit, 52 driving unit, 521 data electrode driving circuit, 522 scan electrode driving circuit, 53 controller, 531 subfield dividing unit, 532 writing pulse supplying unit, 532 maintaining pulse supplying unit, 533 erasing pulse supplying unit, 54 frame memory, 55 A/D converting unit, 56 driving power source, 60 EL element, 61 transparent substrate, 62 transparent electrode, 63 first dielectric layer, 64 light emitting layer, 65 second dielectric layer, 66 counter electrode, 70 1 field, 71 writing period, 72 polarization correction period, 100 EL element, $X_1$ data electrode, $Y_1$ scan electrode

BEST MODE FOR CARRYING OUT THE INVENTION

Hereinafter, display devices and methods of driving a display device according to embodiments of the present invention will be explained by using accompanying drawings. Note that substantially same members in the drawings are denoted by the same reference numerals.

Embodiment 1

A display device and a method of driving a display device according to a first embodiment of the present invention will be explained using FIG. 1 to FIG. 8.

FIG. 1 is a block diagram showing the configuration of a display device 10 according to an embodiment 1 of the present invention. The display device 10 includes a display unit 11 which displays images, a driving unit 12 which drives the display unit 11, and a controller 13 which controls the driving unit 12. The driving unit 12 includes a data electrode driving circuit 121 and a scan electrode driving circuit 122. The controller 13 includes a subfield dividing unit 131, a writing pulse supplying unit 132, a maintaining pulse supplying unit 133, and an erasing pulse supplying unit 134.

Each unit constituting the controller 13 will be explained.

The subfield dividing unit 131 time-divides one field to be displayed by light emission of selected pixels among all pixels, into a plurality of subfields corresponding to the number of gradations to be displayed. The writing pulse supplying unit 132 selects pixels to be emitted light among all pixels, and supplies a writing voltage pulse and a modulation voltage pulse so as to apply a voltage not less than emission starting voltage to light emitting layers of the selected pixels. The maintaining pulse supplying unit 133 supplies a maintaining voltage pulse, to all pixels, with a predetermined pulse number corresponding to the number of gradations (brightness) allocated to subfields. The maintaining voltage pulse starts from a predetermined voltage, which is not more than emission starting voltage of the light emitting layer and has reverse polarity with respect to that of a polarization voltage caused by writing. The polarity of the maintaining voltage pulse is alternately reversed between positive and negative. In this way, in a displaying operation for each subfield, a voltage not more than the emission starting voltage is applied to the light emitting layers of all pixels via all electrodes irrespective of selection of pixels, whereby there is no need to perform selecting operation for each scan electrode. Thus, a light emission maintaining period can be longer. A polarization voltage is not caused in pixels other than those selected in the first writing step of the subfield, whereby false emission will not be caused even if an outside voltage of not more than the emission starting voltage is applied. The brightness allocated to the subfield can be obtained corresponding to the pulse number. The erasing pulse supplying unit 134 supplies an attenuation voltage pulse, to the light emitting layer of each pixel. The attenuation voltage pulse starts from a voltage not more than the emission starting voltage. The polarity of the attenuation voltage pulse is alternately reversed between positive and negative. By applying an attenuation voltage pulse of which the polarity is alternately reversed between positive and negative, polarity charges remaining in the light emitting layers can be almost erased.

Figure 2:
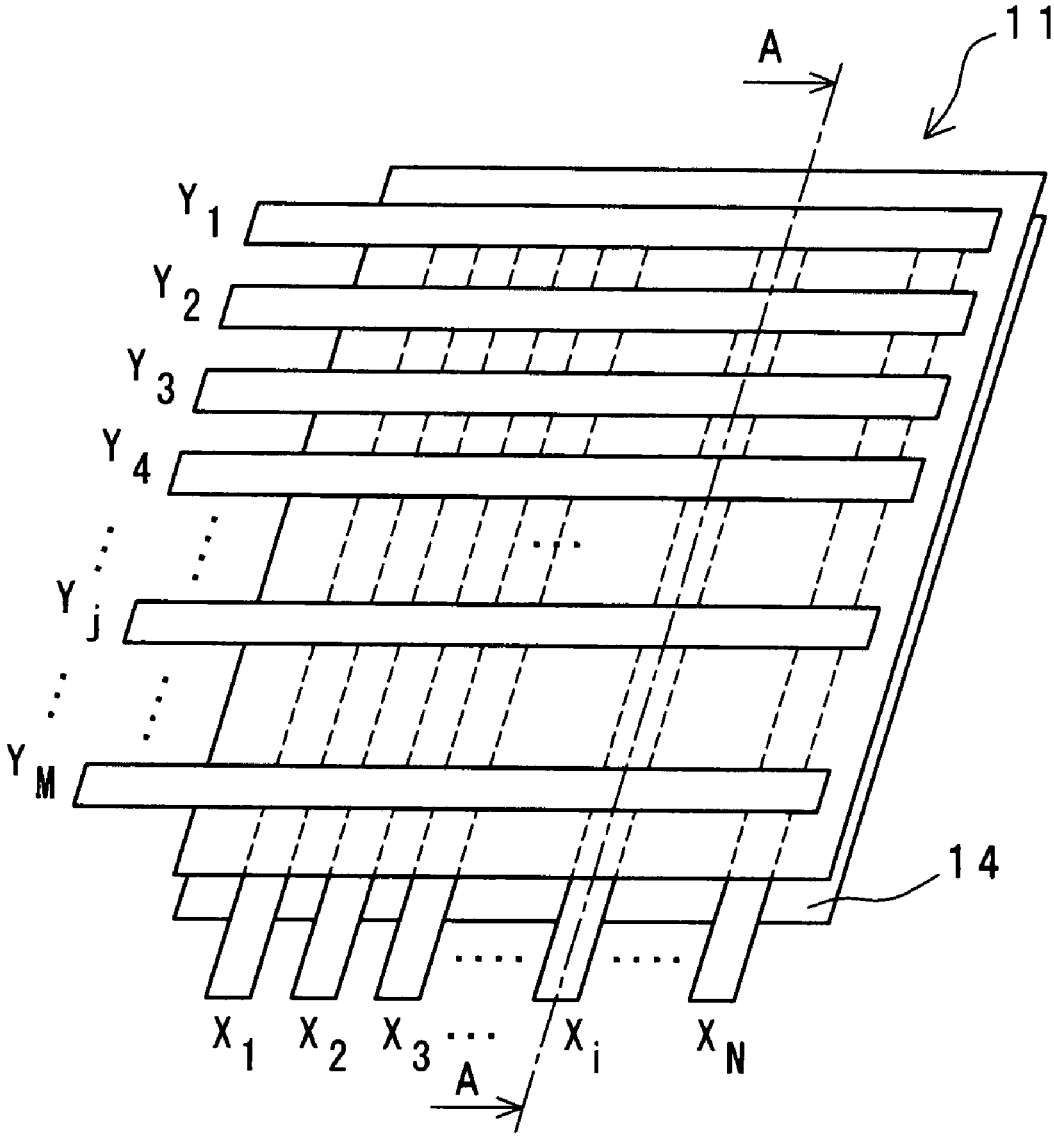
FIG. 2 is a perspective view showing the configuration of a display unit of the display device according to the embodiment 1 of the present invention.

FIG. 2 is a perspective view showing the configuration of the display unit 11. The display unit 11 includes a plurality of data electrodes $X_1, X_2, X_3 \ldots X_i \ldots X_N$ extending along a first direction (row direction in FIG. 1 and FIG. 2) and arranged parallel to each other, and a plurality of scan electrodes $Y_1, Y_2, Y_3 \ldots Y_j \ldots Y_M$ extending along a second direction (line direction in FIG. 1 and FIG. 2) perpendicular to the first direction and arranged parallel to each other. A part where a pair of data electrode $X_i$ and scan electrode $Y_j$ crosses each other is called pixel $C_{ij}$. In the display unit 11, N*M number of pixels $C_{ij}$ are aligned in two dimensions. Further, for each pixel $C_{ij}$, the pixel position is indicated by the subscripts of i and j. For example, pixel $C_{11}$ in FIG. 1 indicates a pixel at a position where data electrode $X_1$ and scan electrode $Y_1$ cross each other. Pixel $C_{21}$ indicates a pixel at a position where data electrode $X_2$ and scan electrode $Y_1$ cross each other, and pixel $C_{12}$ indicates a pixel at a position where data electrode $X_1$ and scan electrode $Y_2$ cross each other. Accordingly, pixel $C_{11}$ and pixel $C_2$, are connected with the scan electrode $Y_1$, and pixel $C_{12}$ is connected with scan electrode $Y_2$. On the other hand, pixel $C_{11}$ and pixel $C_{12}$ are connected with the data electrode $X_1$, and pixel $C_{21}$ is connected with data electrode $X_2$.

Figure 3:
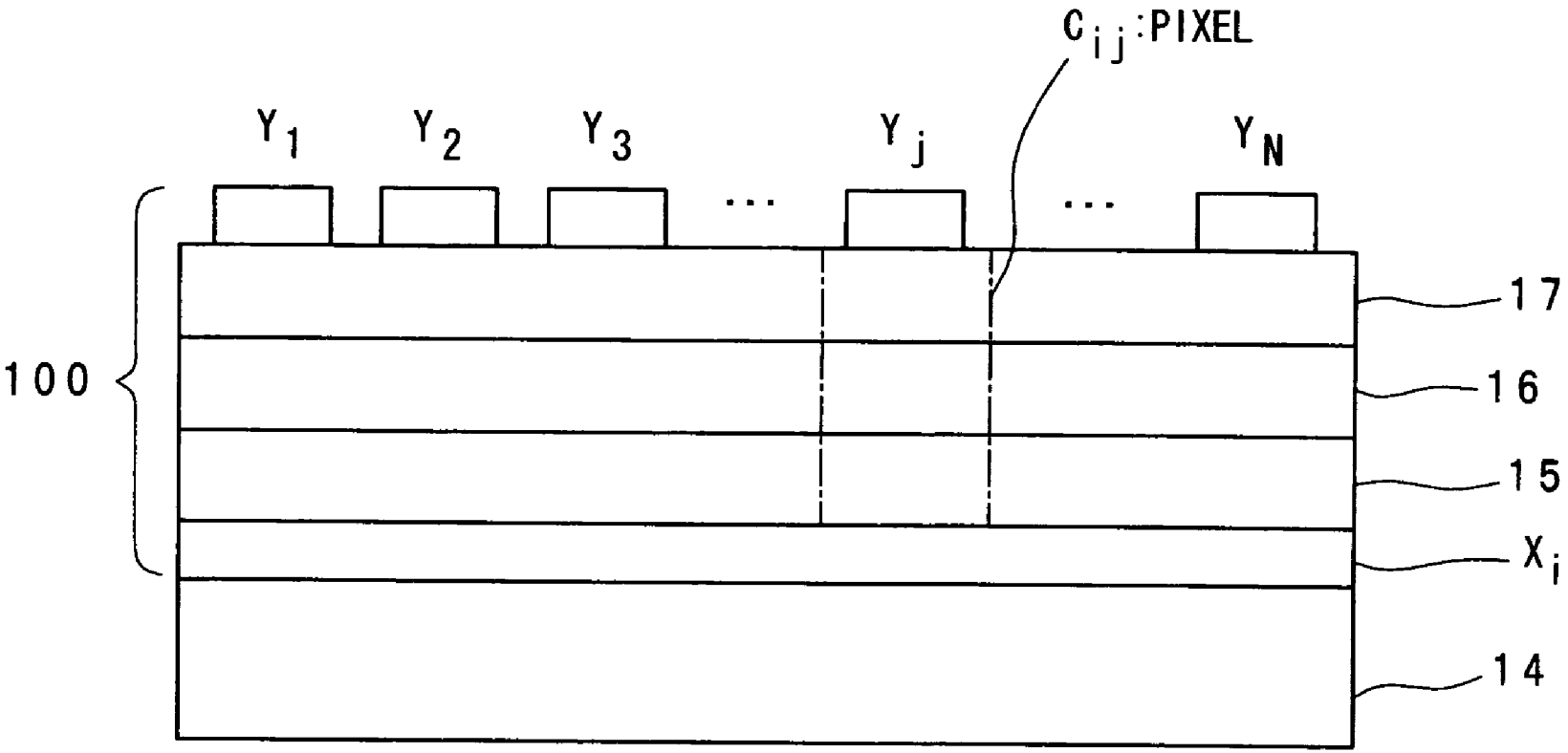
FIG. 3 is a sectional view taken along the line A-A in FIG. 2.
Figure 13:
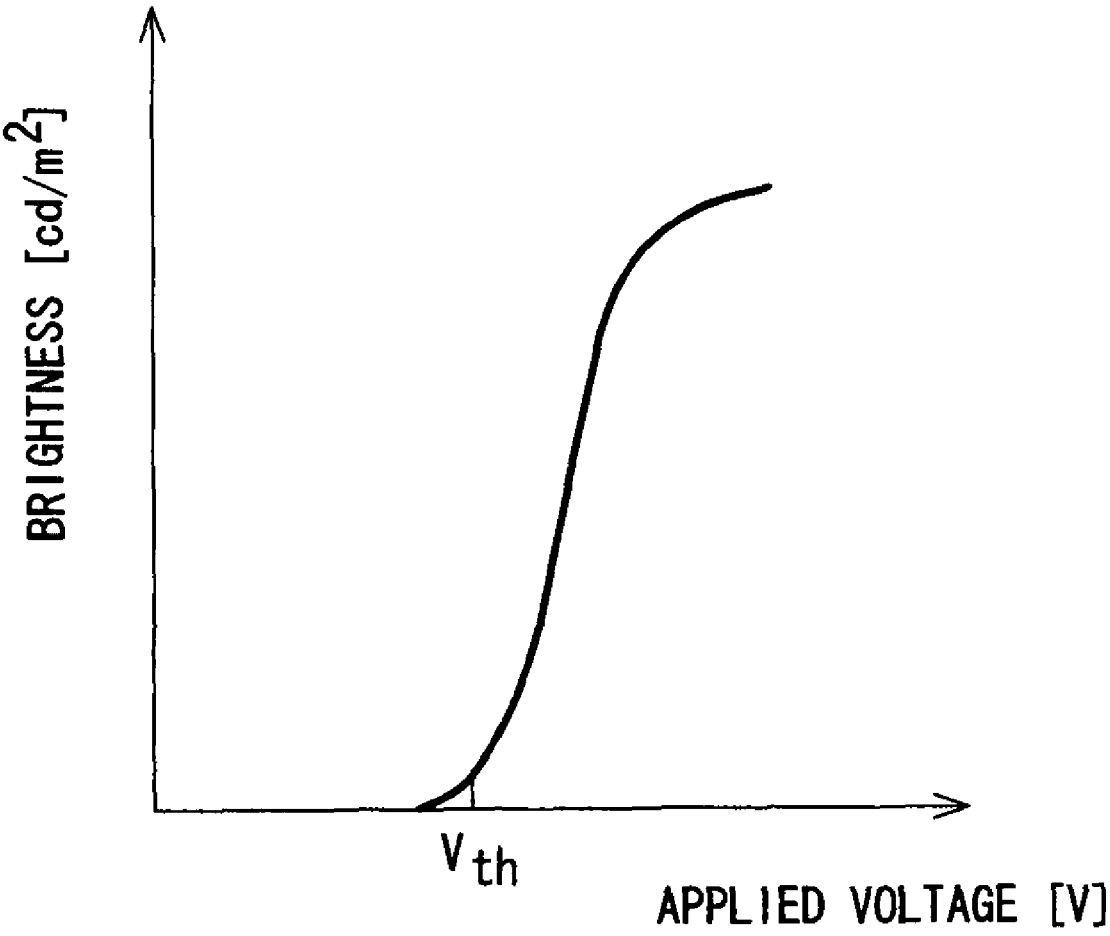
FIG. 13 is a graph showing the applied voltage-brightness characteristics of an EL element.
Figure 14:
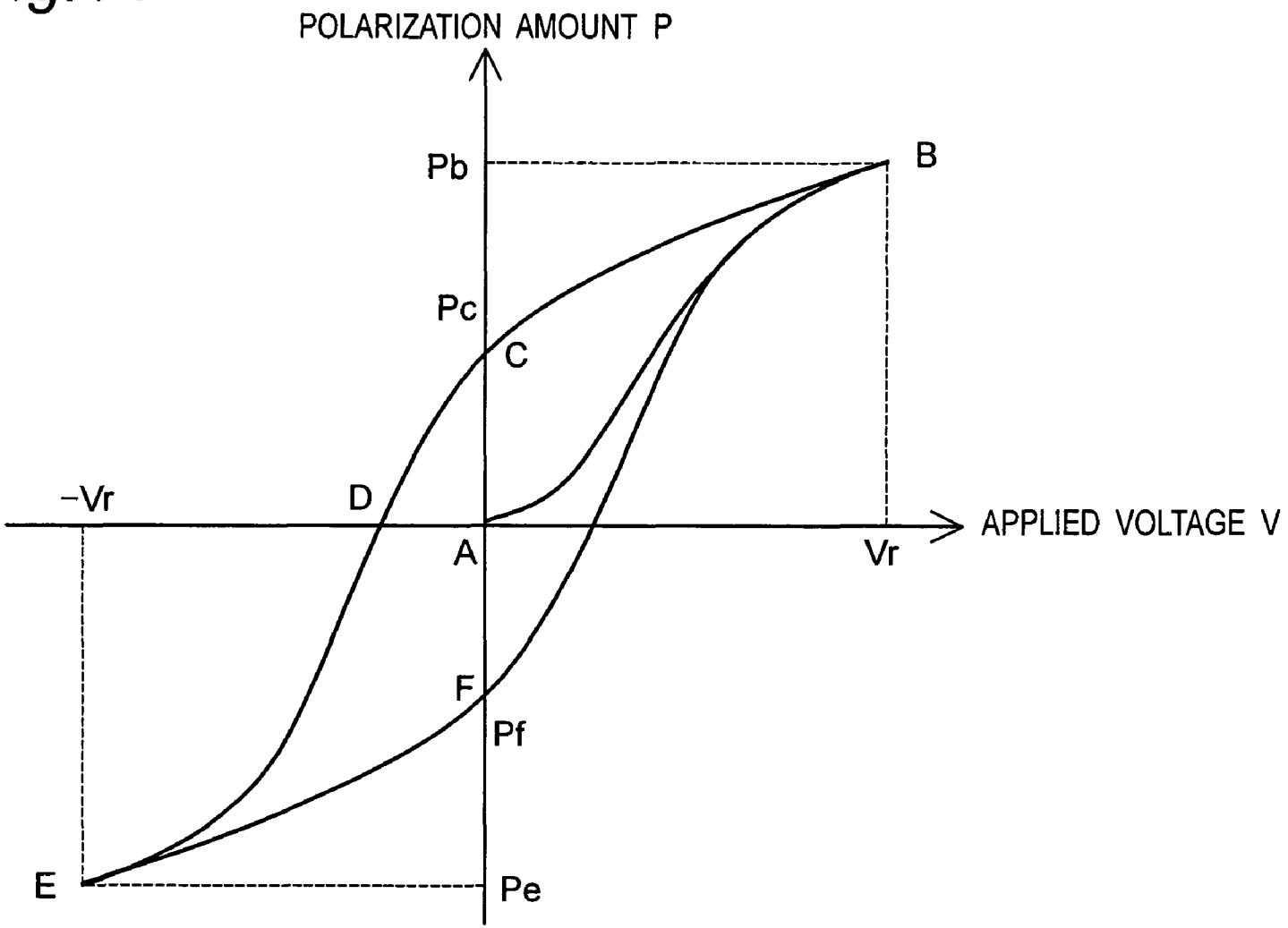
FIG. 14 is a graph showing the hysteresis characteristics of polarization charges in a light emitting layer of an EL element.
Figure 15:
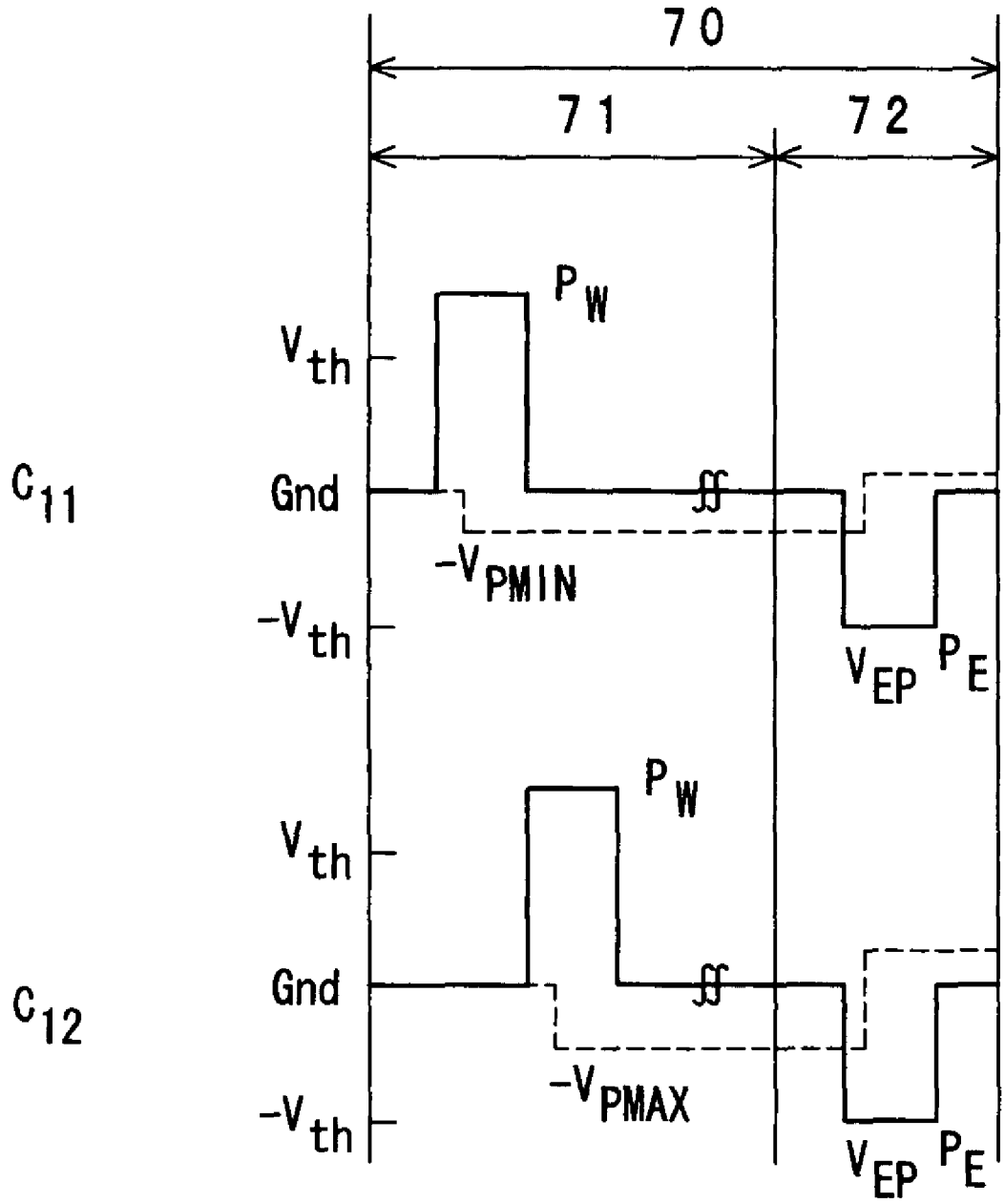
FIG. 15 is a time chart showing a conventional method of driving a display device in which a polarization correction voltage is applied.

FIG. 3 is a sectional view taken along the line A-A in FIG. 2, perpendicular to the light emitting face. As shown in FIG. 3, each pixel $C_{ij}$ includes data electrode $X_1$, first dielectric layer 15, light emitting layer 16, second dielectric layer 17, and scan electrode $Y_j$, provided on the substrate 14 in order. Each pixel $C_{ij}$ corresponds to one EL element 100. Each EL element 100 has characteristic features between applied voltage and brightness, as shown in FIG. 13. Therefore, it can be considered that plurality of EL elements 100 are aligned in two dimensions in the display unit 11. Although, in this embodiment, the first dielectric layer 15, the light emitting layer 16, and the second dielectric layer 17 are provided as continuing layers through each pixel $C_{ij}$, the present invention is not limited to this configuration. A configuration in which a predetermined layer among the first dielectric layer 15, the light emitting layer 16, and the second dielectric layer 17 is provided separately for each pixel $C_{ij}$ is acceptable. For example, the light emitting layer 16 may be separated for each pixel $C_{ij}$. Alternatively, an EL element 100 may be provided separately for each pixel $C_{ij}$ excluding data electrode $X_1$ and scan electrode $Y_j$, and an EL element array in which EL elements 100 are aligned two dimensionally may be used. In such a case, EL elements 100 should be provided to all pixels $C_{ij}$ where N number of data electrodes $X_i$ and M number of scan electrode $Y_j$ cross each other, respectively.

Further, it is preferable that the second dielectric layer 17 and scan electrode $Y_j$ be made of transparent materials. In such a case, light emitted from the light emitting layer 16 can be taken out through the second dielectric layer 17 and scan electrode $Y_j$. Hereinafter, the first dielectric layer 15, the second dielectric layer 17 and scan electrode $Y_j$ will be explained.

The first dielectric layer 15 and the second dielectric layer 17 preferably have high insulative property and high dielectric constant, such that the EL element will not be broken when a high electric field is applied. The first and second dielectric layers 15, 17 preferably have few pinholes or defects, so that the EL elements will not be broken. The first and second dielectric layers 15, 17 preferably have good adhesion, since the layers are laminated with the light emitting layer and electrodes. As for a display, film thickness and film quality of the first and second dielectric layers 15, 17 may be preferably uniform, and the first and second dielectric layers 15, 17 may be easily provided throughout a large area. If a high temperature process is required when manufacturing the EL element, the first and second dielectric layers 15, 17 preferably have high heat resistance. In particular, the first and second dielectric layers 15, 17 preferably have a non-propagation type feature in which insulating breakage will not spread all over the EL element. A transparent material with respect to visible light is preferably used for at least one of the first dielectric layer 15 and the second dielectric layer 17, so that emission can be taken out from the light emitting layer 16. A ferroelectric material may be used as the first dielectric layer 15 and the second dielectric layer 17. As the ferroelectric material, besides $BaTiO_3$ mentioned above, $(Ba, Sr)TiO_3$, $(Pb, La)TiO_3$, $(Pb, La)(Zr, Ti)O_3$, $(Bi, Na)TiO_3$, $(Bi, Ni)TiO_3$, $(Bi, La)TiO_3$, and $KNbO_3$, $NaNbO_3$, $LiNbO_3$ and $LiTaO_3$ having pseudo-ilmenite structure, and $PbNb_2O_6$ and $Ba_2NaNbO_{15}$ having tungsten-bronze structure, and $Cd_2Nb_2O_7$ and $Pb_2Nb_2O_7$, having the pyrochlore structure, $Bi_4Ti_3O_{12}$, $SrBi_2Ta_2O_9$ and $CaBi_4Ti_4O_{15}$ having bismuth layer structure, and their compounds, and compounds of these and dielectric material can be used. A ferroelectric can be deposited by sputtering, EB vapor deposition, resistance heating vapor deposition, CVD, screen printing, spin coating, inkjet, dipping, bar coating, and other well-known deposition methods. On this dielectric layer, heat treatment may be performed in order to adjust residual polarization Pr and coercive electric field Ec of the ferroelectric characteristics. If the residual polarization Pr is large, the polarization voltage inside the EL element becomes larger, whereby the difference between the emission starting voltage and the maintaining voltage becomes larger, so the operational margin can be enlarged. As for the residual polarization Pr, 3 $\mu C/cm^2$ or more is preferable, and 5 $\mu C/cm^2$ or more is more preferable. On the other hand, if the coercive electric field Ec is too large, electric power loss caused by polarization reversal in the dielectric layer increases, so the coercive electric field is preferably 1 MV/cm or less, and more preferably, 0.5 MV/cm or less. In order to prevent defective formation when depositing the light emitting layer 16 or to take out light emitted from the light emitting layer 16 to the outside effectively, smoothing processing such as polishing may be performed so as to smooth the surface of the dielectric layer or a smooth layer may be provided on the dielectric layer. The film thickness of the ferroelectric may be adjusted by Pr, Ec and the like of the ferroelectric.

As an electric material having a transparent property, ITO (indium tin oxide), InZnO, ZnO, $SnO_2$ or the like is used as a particularly preferable example, but it is not limited to these. Conductive resin such as poly-aniline, poly-pyrrole and PEDOT/PSS can be also used. The film thickness of this electrode is determined depending on the sheet resistance and visible light transmittance required. In the case of a color display device, color display is realized by means of stripe alignment or delta alignment of RGB pixels, generally. A scan electrode arranged for each scan line can have a larger electrode width relative to a data electrode arranged for each RGB pixel. A light transparent electrode such as ITO has larger resistance compared with a metallic electrode, so by using it as a scan electrode having a large electrode width, electrode resistance can be suppressed lower.

As the light emitting layer 16, a well-known fluorescent material can be used, which includes group 12 to 16 compounds such as ZnS and ZnSe, group 2 to 16 compound fluorescent materials such as CaS and SrS, mixed crystal of the above-mentioned compounds such as ZnMgS, CaSSe and CaSrS, or compounds which may be unevenly crystallized or segregated partially, thiogallate based fluorescent material such as $CaGa_2S_4$, $SrGa_2S_4$ and $BaGa_2S_4$, thioaluminate fluorescent material such as $CaAl_2S_4$, $SrAl_2S_4$ and $BaAl_2S_4$, metal oxide fluorescent materials such as $Ga_2O_3$ and $Y_2O_3$, and multiple oxide fluorescent material such as $Zn_2SiO_4$. To each of these fluorescent materials, at least one element selected from the metallic elements such as Mn, Cu, Ag, Sn, Pb, Pr, Nd, Sm, Eu, Tb, Dy, Ho, Er, Tm, Yb, Ce, Ti, Cr, and Al is activated. As an activator, a non-metallic element such as Cl or I or a fluoride such as $TbF_3$ or $PrF_3$ may be used. Two kinds thereof or more, among the above-mentioned activators, may be used at the same time. As a depositing method of the light emitting layer 16, sputtering, EB vapor deposition, resistance heating vapor deposition, CVD, inkjet, dipping, spin coating, screen printing, bar coating and other well-known deposition methods may be used.

By depositing the light emitting layer 16 with RGB phosphors for the respective colors, a color display device can be obtained. Alternatively, another example of a color display device can be obtained by using color filters and/or color conversion filters so as to display the respective colors of RGB after producing a display device of single color or two color light emitting layer.

Figure 4:
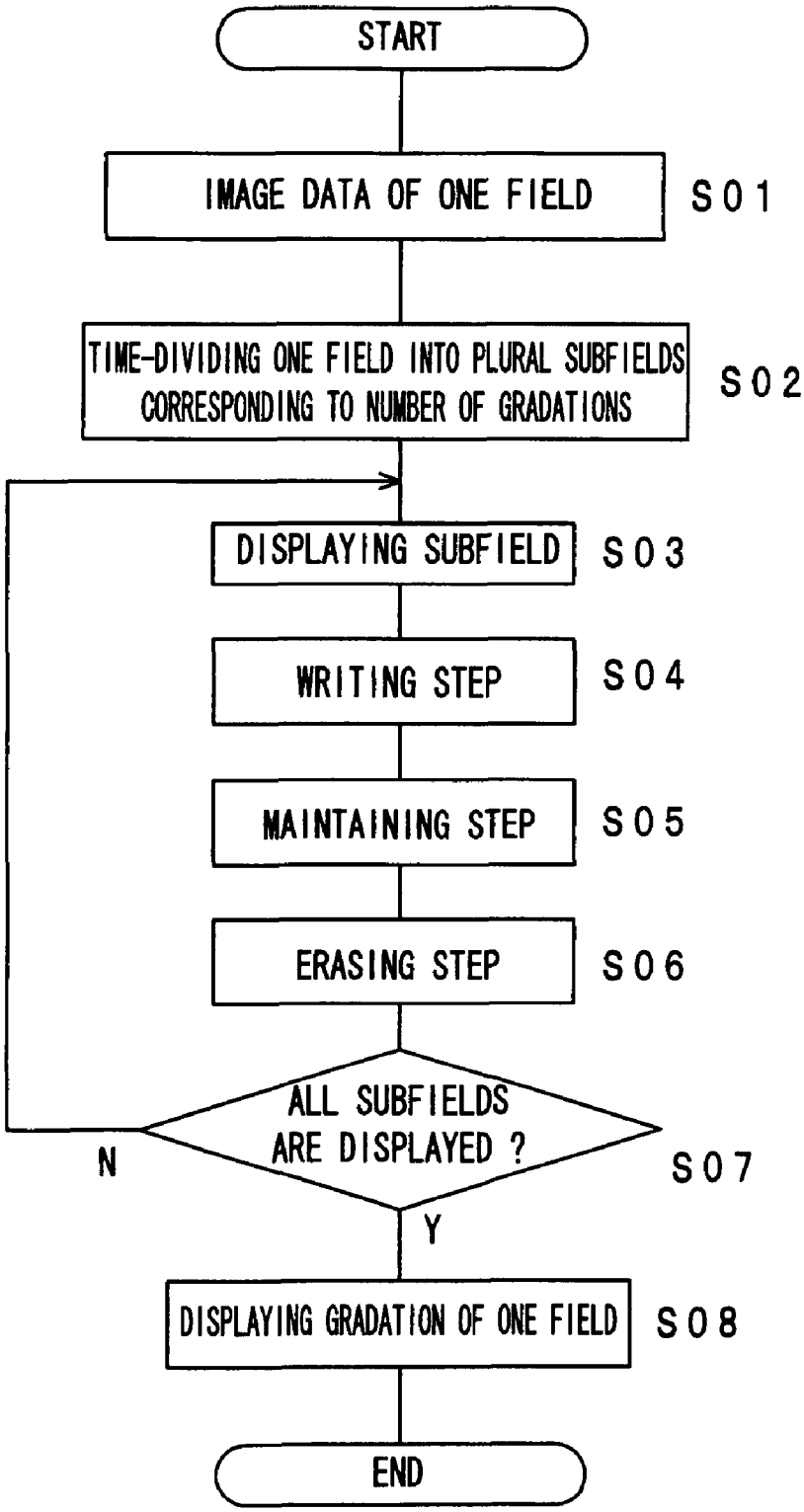
FIG. 4 is a flowchart showing a method of driving the display device according to the embodiment 1 of the present invention.

Next, a method of driving the display device 10 will be explained by using FIG. 1 and FIGS. 4 to 6. FIG. 4 is a flowchart showing a method of driving the display device 10.

(a) First, image data S1 for one field is inputted into the subfield dividing unit 131 (S01).

Figure 5:
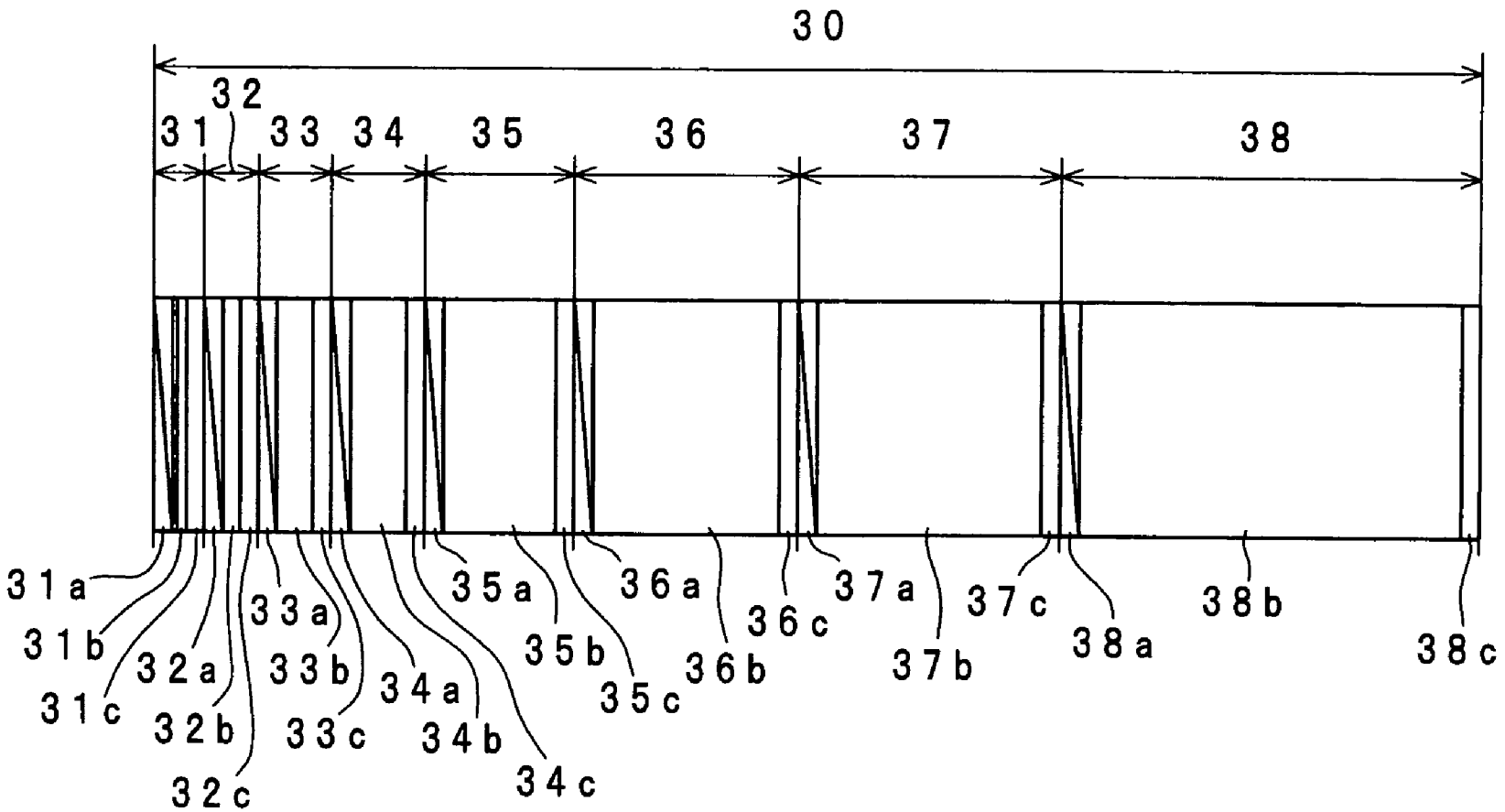
FIG. 5 is a time chart showing respective steps of respective subfields constituting one field in the method driving the display device according to the embodiment 1 of the present invention.

(b) Then, as shown in FIG. 5, the subfield dividing unit 131 time-divides one field 30 into n number (eight in FIG. 5) of subfields 31 to 38 to which brightness corresponding to the number of gradations $2^n$ to be displayed (S02). In the divided n number of subfields, the time length of a maintaining period is set so as to correspond to the weight of brightness allocated. The time lengths of the maintaining periods of the n number of subfields 31 to 38 increase to be twice sequentially from the shortest subfield 31 to the longest subfield 38, and there are $2^n$ stages of combinations of subfields which cause pixels to emit light. Therefore, by selecting a time period in which a pixel emits light as a combination of subfields causing the pixel to emit light, gradation control of $2^n$ stages is realized.

Figure 6:
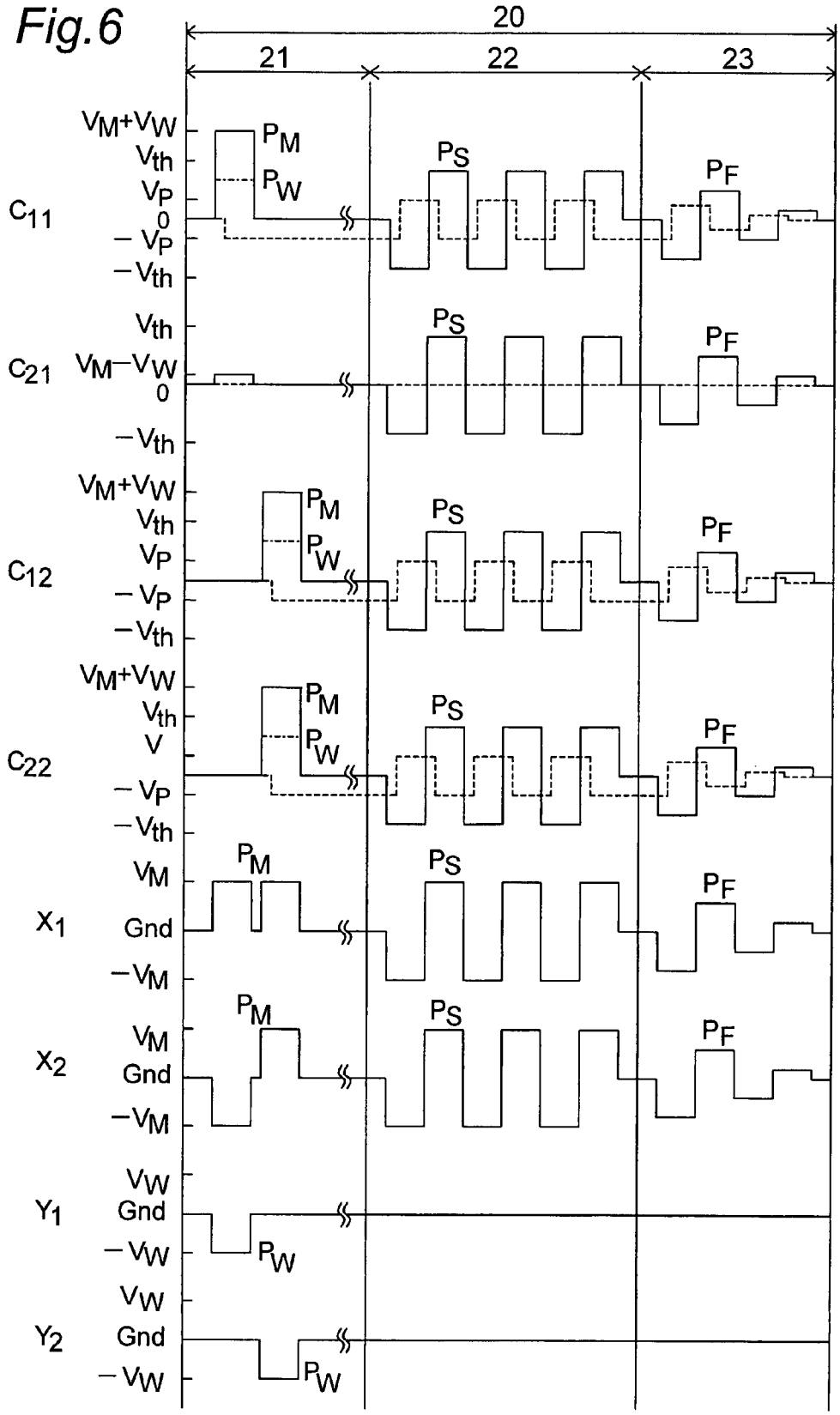
FIG. 6 is a waveform chart showing outside voltages applied to light emitting layers of respective pixels and polarization voltages caused inside the lithe emitting layers of the respective pixels in one subfield, in the method of driving the display device according to the embodiment 1 of the present invention.

(c) Further, as shown in FIG. 6, the subfield dividing unit 131 time-divides the subfield 20 into a writing period 21, a maintaining period 22 and an erasing period 23.

(d) In the display of each subfield (S03), a writing step (S04) for selecting pixels of the display unit is performed corresponding to image data to be displayed in the writing period 21. Then, a maintaining step (S05) is performed in the maintaining period 22, and an erasing step (S06) is performed in the erasing period 23, whereby display operation of one subfield is completed.

(e) By performing the display operation for n number of subfields (S07), display operation for one field is completed (S08).

Hereinafter, each display operating step will be explained in more detail.

FIG. 5 is a diagram showing a display operation of one field 30 required to display one image on the display device 10 shown in FIG. 1. In the present embodiment, an explanation will be given for the case where the number of gradations is $2^8$. One field 30 is divided into eight subfields 31 to 38, and the respective subfields 31 to 38 include writing periods 31*a* to 38*a* for selecting emissive pixels, maintaining periods 31*b* to 38*b* for causing the selected emissive pixels to emit light at a predetermined luminance, and erasing periods 31*c* to 38*c* for uniformly erasing the state of polarization charges formed in the light emitting layers of the respective pixels in all pixels. In the maintaining periods 31*b* to 38*b*, the time lengths are set to 1T (T is a temporal basic length of a clock signal), 2T, 4T, 18T, 16T, 32T, 64T and 128T such that relative ratios of the brightness allocated to the respective subfields 31 to 38 become $1/2^8$, $1/2^7$, $1/2^6$, $1/2^5$, $1/2^4$, $1/2^3$, $1/2^2$ and $1/2^1$, respectively. By emitting light in the maintaining periods 31*b* to 38*b* selectively, a display image of one field of 30 units can be expressed in 256 gradations. Although subfields 31 to 38 are arranged in the ascending order of the temporal lengths of the maintaining periods 31*b* to 38*b* in FIG. 5, the order of the subfields can be selected arbitrarily, and is not limited to that described above. In some display devices, unnaturalness is easily caused in moving images if arranged in the order of temporal length, so the optimum order appropriate for a display device is desirable.

FIG. 6 is a waveform chart showing outside voltages (shown by actual lines in the Figure) applied to the light emitting layers 16 of pixels $C_{11}$, $C_{21}$, $C_{12}$ and $C_{22}$ in one subfield 20 and polarization voltages (shown by broken lines in the Figure) caused by polarization charges inside the light emitting layers 16 of the pixels, in the method of driving the display device 10 according to the present invention. Further, it is also a waveform chart showing voltages outputted from the driving unit 12 to data electrodes $X_1$ and $X_2$ and scan electrodes $Y_1$ and $Y_2$. This subfield 20 is time-divided into the writing period 21 and the following maintaining period 22, and the following erasing period 23. In FIG. 6, pixels $C_{11}$, $C_{12}$ and $C_{22}$ shown in FIG. 1 are shown as pixels which should emit light (hereinafter referred to as emissive pixels for short), and pixel $C_{21}$ is shown as a pixel which should not emit light (hereinafter referred to as non-emissive pixel for short). Note that in the present specification and drawings, a voltage applied to a light emitting layer means a potential difference based on a scan electrode, and the voltage of a scan electrode is indicated as 0.

Figure 7A:
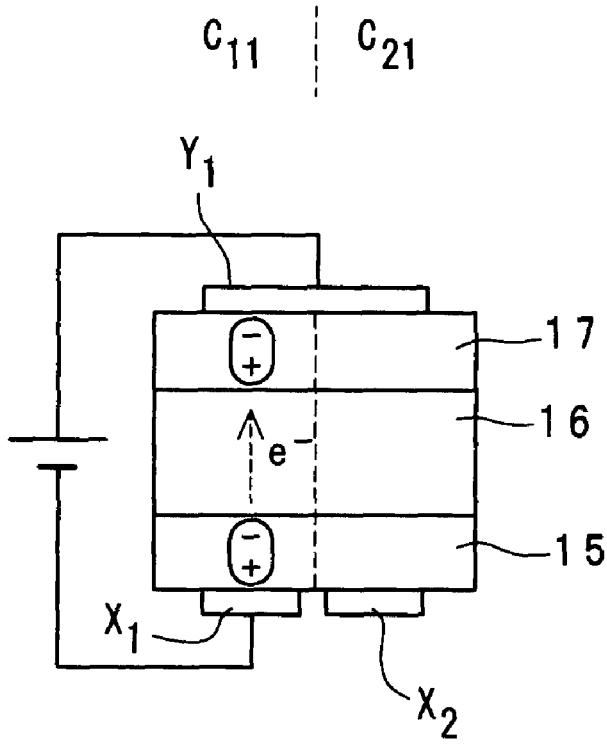
FIG. 7A is a diagram showing the charge movement in the case where light is emitted by applying a voltage not less than an emission starting voltage to selected pixels.
Figure 7B:
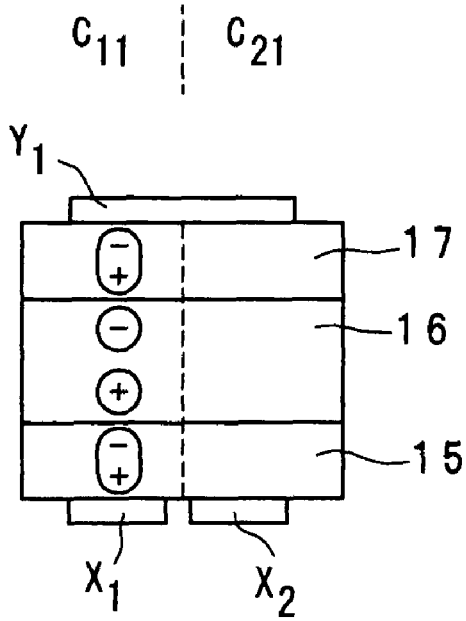
FIG. 7B is a diagram showing the formation of polarization charges when the applied voltage is erased after light emission of FIG. 7A.

FIGS. 7A and 7B are diagrams schematically showing states of charge movements in an EL element in the writing step. FIG. 7A shows a state where, in the writing step, a current flows through the light emitting layer 16 when a voltage not less than emission starting voltage $V_{th}$ is applied to pixel $C_{11}$ selected as an emissive pixel so as to cause light emission. FIG. 7B shows polarization voltage remaining in the light emitting layer 16 after the writing step.

First, the writing step (S04) will be explained. The writing step is performed in the writing period 21 shown in FIG. 6 for each scan electrode $Y_1, Y_2, Y_3 \ldots Y_j \ldots Y_M$ in the linear order. When performed, a writing voltage pulse $P_W$ (applied voltages $-V_W$ to the light emitting layer 16, $V_W$ is a real numbers having the relationship of $0<V_W<V_{th}$, hereinafter referred to as writing voltage for short) is sequentially applied to each of scan electrodes $Y_1, Y_2, Y_3 \ldots Y_j \ldots Y_M$ from the writing pulse supplying unit 132 via the scan electrode driving circuit 122 of the driving unit 12. At the same time, to a data electrode $X_1$ selected for each scan electrode $Y_1, Y_2, Y_3 \ldots Y_j \ldots Y_M$, a modulation voltage pulse $P_M$ (applied voltage $V_M$ or $-V_M$ to the light emitting layer 16, $V_M$ is a real number having the relationship of $0<V_M<V_{th}$, hereinafter referred to as a modulation voltage for short) is selectively applied from the writing pulse supplying unit 132 via the data electrode driving circuit 121 of the driving unit 12. More specifically, a modulation voltage $V_M$ of reverse polarity with respect to that of the writing voltage $-V_W$ is applied to an emissive pixel (e.g., pixel $C_{11}$ shown in FIG. 6), and a modulation voltage $-V_M$ of the same polarity with respect to that of the writing voltage $-V_W$ is applied to a non-emissive pixel (e.g., pixel $C_{21}$ shown in FIG. 6). Here, the writing voltage $V_W$ and the modulation voltage $V_M$ are given as values satisfying the following inequalities (2) and (3).

$$V_W+V_M>V_{th} \tag{2}$$

$$|V_W-V_M|<V_{th} \tag{3}$$

Through the writing step, for example in emissive pixel $C_{11}$ selected by a pair of scan electrode $Y_1$ and data electrode $X_1$, superposed effect of the writing voltage $V_W$ and the modulation voltage $V_M$ is caused, and a differential voltage $V_M-(-V_W)=V_M+V_W$ is applied. The differential voltage $V_M+V_W$ satisfies the inequality (2), and the voltage is not less than the emission starting voltage $V_{th}$ (FIG. 6). At this time, as shown in FIG. 7A, in the light emitting layer 16 of the emissive pixel $C_{11}$, the current contributing to emission flows within a period of several μ seconds as described above. As a result, polarization charges remain in the both interfaces between the light emitting layer 16 and the first dielectric layer 15 and the second dielectric layer 17 of pixel $C_{11}$. Thereby, polarization voltage $(-V_p)$ having reverse polarity with respect to that of the differential voltage between writing voltage $V_W$ and the modulation voltage $V_M$ is caused inside the light emitting layer 16 as shown by the dotted line of light emitting pixel $C_{11}$ in FIG. 6 (FIG. 7B). As for $C_{12}$ selected by a pair of scan electrode $Y_2$ and data electrode $X_1$ shown in FIG. 6 and $C_{22}$ selected by a pair of scan electrode $Y_2$ and data electrode $X_2$, polarization voltage $(-V_p)$ is caused similarly. On the other hand, in non-emissive pixel $C_{21}$, an offset effect is caused by writing voltage $V_W$ applied by the scan electrode $Y_1$ and modulation voltage $V_M$ applied by data electrode $X_2$, and differential voltage $-V_M-(-V_W)=V_W-V_M$ between them is applied. The differential voltage $V_W-V_M$ satisfies the inequality (3), so the voltage is less than emission starting voltage $V_{th}$, whereby light is not emitted. Accordingly, no polarization charge remains in the light emitting layer 16 of non-emissive pixel $C_{21}$. (FIG. 6, FIG. 7B).

Relationships with an output voltage to each electrode in this driving operation will be explained in more detail based on FIG. 1 to FIG. 6. Note that a voltage outputted to each electrode means a potential difference from the predetermined reference, and the predetermined reference is indicated as GND potential. In FIG. 6, a voltage allocated to the light emitting layer by outside voltage $V_W'$ applied to the EL element is indicated as $V_W$, for example. By the scan electrode driving circuit 122 inside the driving unit 12, scan electrodes $Y_1, Y_2, Y_3, \ldots Y_j \ldots Y_M$ are selected sequentially to which the writing voltage $-V_W'$ is applied corresponding to an arbitral clock signal (frequency). At the same time, by the data electrode driving circuit 121, two values are applied selectively, that is, a modulation voltage $V_M$ is applied to data electrodes connected with the emissive pixels (pixels $C_{11}$, $C_{12}$, $C_{22}$ in FIG. 6) and modulation voltage $-V_M'$ is applied to the data electrode connected with the non-emissive pixel (pixel $C_{21}$ in FIG. 6). For example, assuming that $V_W'$ is 150V and $V_M'$ is 100V, the differential voltage between the writing voltage and the modulation voltage is about 250V. In the non-emissive pixel, the differential voltage between the writing voltage and the modulation voltage is about 50V. In this way, desired display data is written. Assuming that the outside applied voltage $V_{th}'$ when light emission starts is 200V, only emissive pixels emit light selectively. Consequently, polarization charges are formed selectively in the light emitting layers 16. Further, emissive pixel $C_{12}$ shown in FIG. 6 will be explained. The emissive pixel $C_{12}$ is a place where scan electrode $Y_2$ and data electrode $X_1$ cross each other. In the writing period 21, writing is performed in the linear order by each scan electrode, so after a writing voltage pulse is applied to scan electrode $Y_1$, the writing voltage pulse is applied to the scan electrode $Y_2$. Therefore, the step of writing into emissive pixel $C_{12}$ is performed after the step of writing into emissive pixel $C_{11}$, and then writing step is performed to scan electrodes $Y_3$ to $Y_M$ in the linear order. Note that the data writing method described above (pixel selecting method) is an example, and another writing method is also acceptable. Further, although the writing method described above shows a case where the writing voltage pulse $P_W$ is a negative voltage pulse, a method in which the writing voltage pulse $P_W$ is a positive voltage pulse or a method in which positive a voltage pulse and negative voltage pulse are switched alternately by field or by subfield is acceptable. In this case, the voltage polarity of the modulation voltage pulse $P_M$ corresponding to emissive pixel/non-emissive pixel may be changed according to the voltage polarity of the writing voltage pulse $P_W$. Further, although, in the writing method described above, output reference voltages to the data electrodes of the modulation voltage pulse $P_M$ are two values of positive and negative voltages of $V_M$ and $-V_M$, different voltages or a case where one condition is GND potential is also acceptable.

Next, the maintaining step (S05) will be explained. The maintaining step (S05) is performed to all data electrodes $X_1$, $X_2$, $X_3$ . . . $X_i$ . . . $X_N$ simultaneously. When performed, maintaining voltage pulse $P_S$ (applied voltage $V_S$ or $-V_S$ to the light emitting layer 16, hereinafter referred to as a maintaining voltage for short) is applied to data electrodes $X_1$, $X_2$, $X_3 \ldots X_i \ldots X_N$ from the maintaining pulse supplying unit 133 via the data electrode driving circuit 121 of the driving unit 12. Here, the maintaining voltage pulse $P_S$ is alternately reversed between positive and negative. The maintaining voltage pulse $P_S$ starts from a voltage of reverse polarity with respect to that of the differential voltage between the writing voltage $V_W$ and the modulation voltage $V_M$, that is, the same polarity with respect to that of a polarization voltage $V_P$ caused inside the light emitting layer. The maintaining voltage $V_S$ is given as a value (real number) satisfying the following inequality (4).

$$V_{th}-V_P<V_S<V_{th} \tag{4}$$

That is, the polarization voltage ($-V_P$) is superposed only to the emissive pixels $C_{11}$, $C_{12}$ and $C_{22}$ in which polarization charges are formed inside the light emitting layers 16 of the pixels by the writing step (S04). It is considered that the emission starting voltage is lowered by the polarization voltage, substantially. Therefore, by applying the maintaining voltage pulse $P_S$ starting from the maintaining voltage ($-V_S$) of the same polarity as that of the polarization voltage $V_P$ so as to satisfy the inequality (4), the effective voltage applied to the light emitting layer of the emissive pixel exceeds the emission starting voltage $V_{th}$ whereby light is emitted. Further, with this emission, polarization charges of reverse polarity with respect to that of the maintaining voltage pulse $P_S$ are formed inside the light emitting layers 16 of emissive pixels $C_{11}$, $C_{12}$ and $C_{22}$, so a polarization voltage $V_P$ is caused. Then, the next maintaining voltage ($V_S$) pulse of reverse polarity with respect to that of the maintaining voltage ($-V_S$) of the first maintaining voltage pulse is applied to all pixels, and in the emissive pixel, the voltage $V_S$ of the maintaining voltage pulse of the same polarity as that of the polarization voltage is superposed to the polarization voltage $V_P$ remaining in the light emitting layer by the previous maintaining voltage pulse, so the effective voltage applied to the light emitting layer 16 exceeds the emission starting voltage $V_{th}$, whereby light is emitted. Even in this case, polarization charges of reverse polarity with respect to that of the voltage of the maintaining voltage pulse are formed. Then, the maintaining voltage pulse of the pulse number corresponding to the number of gradations allocated to the subfield is applied alternately between positive and negative.

Note that the output voltage $V_S'$ of the maintaining voltage pulse $P_S$ and the output voltage $V_M'$ of the modulation voltage pulse $P_M$ may be the same voltage as shown in FIG. 6. Although it is preferable that the maintaining voltage pulse $P_S$ starts from a voltage of reverse polarity with respect to that of the differential voltage between the writing voltage $V_W'$ and the modulation voltage $V_M$, it may start from a voltage of the same polarity as that of the differential voltage between the writing voltage $V_W$ and the modulation voltage $V_M$, that is, a voltage of reverse polarity with respect to that of the polarization voltage $V_P$ caused inside the light emitting layer. In such a case, light is not emitted at the first pulse, and light is emitted starting from the next pulse. Although there has been described a method in which the maintaining voltage pulse $P_S$ is supplied from all data electrodes $X_1$, $X_2$, $X_3 \ldots X_i \ldots X_N$, a method in which it is supplied from all scan electrodes $Y_1$, $Y_2$, $Y_3 \ldots Y_j \ldots Y_M$ is also acceptable.

On the other hand, non-emissive pixel $C_{21}$ has no polarization charge and no polarization voltage caused in the light emitting layer. Only a maintaining voltage $V_S$ of not more than the emission starting voltage $V_{th}$ is applied to pixel $C_{21}$ during the maintaining period. The effective voltage applied to the light emitting layer 16 is less than the emission starting voltage $V_{th}$, thereby pixel $C_{21}$ cannot emit. The maintaining voltage pulse $P_S$ is applied to all pixels. The maintaining voltage pulse $P_S$ starts from a starting voltage, which is not more than the emission starting voltage $V_{th}$ and has reverse polarity with respect to the polarity at the point of applying the writing voltage and the modulation voltage. The polarity of the maintaining voltage pulse $P_S$ is alternately reversed between positive and negative. It is possible to set such that light emission is continued during the maintaining period 22 in emissive pixels $C_{11}$, $C_{12}$ and $C_{22}$, and light is not emitted during the maintaining period 22 in the non-emissive pixel $C_{21}$.

As described above, the maintaining period 22 during which the maintaining step is performed is set so as to correspond to the number of gradations allocated to n number of subfields divided according to the number of gradations $2^n$ indicated by the temporal length thereof. The number of emissions of each field is the number of integrated times of the writing voltage pulse in the writing step and the pulse number of the maintaining voltage pulse $P_S$ in the maintaining step. This corresponds to the number of gradations allocated to each subfield. As for the number of gradations of one field, the number of gradations of $2^n$ stages can be obtained by selecting from combinations of emission/non-emission of each subfield.

Next, erasing step (S06) will be explained. The erasing step is performed simultaneously to all data electrodes $X_1$, $X_2$, $X_3 \ldots X_i \ldots X_N$ shown in FIG. 1 in the erasing period 23. When the erasing step is performed, the erasing voltage pulse $P_E$ is applied to each data electrode $X_1$, $X_2$, $X_3 \ldots X_i \ldots X_N$ from the erasing pulse supplying unit 134 via the data electrode driving circuit 121 of the driving unit 12. Here, the erasing voltage pulse $P_E$ is attenuation voltage pulse which starts from a voltage ($-V_{E1}$) of reverse polarity with respect to the polarity of the last pulse of the maintaining voltage pulse $P_S$ and in which the polarity is alternately reversed between positive and negative as shown in FIG. 6. The erasing voltage pulse $P_E$ has, for example, a waveform in which a rectangle pulse is alternately reversed between positive and negative, and the applied voltage (hereinafter referred to as erasing voltage) is attenuated. The erasing voltage $V_E$ is, in the case where the last pulse of the maintaining voltage pulse $P_S$ has positive polarity, given as the attenuation voltage pulse in which absolute value of the applied voltage decreases gradually like $-V_{E1}$, $V_{E2}$, $-V_{E3}$, $V_{E4}$ . . . (where respective voltages are in the relationship of $V_{th}>V_S>V_{E1}>V_{E2}>V_{E3}>V_{E4}>0$). Thereby, polarization charges formed inside the light emitting layer 16 of the pixel are erased, and in the writing step of the next subfield, writing of display data is newly performed.

Figure 8:
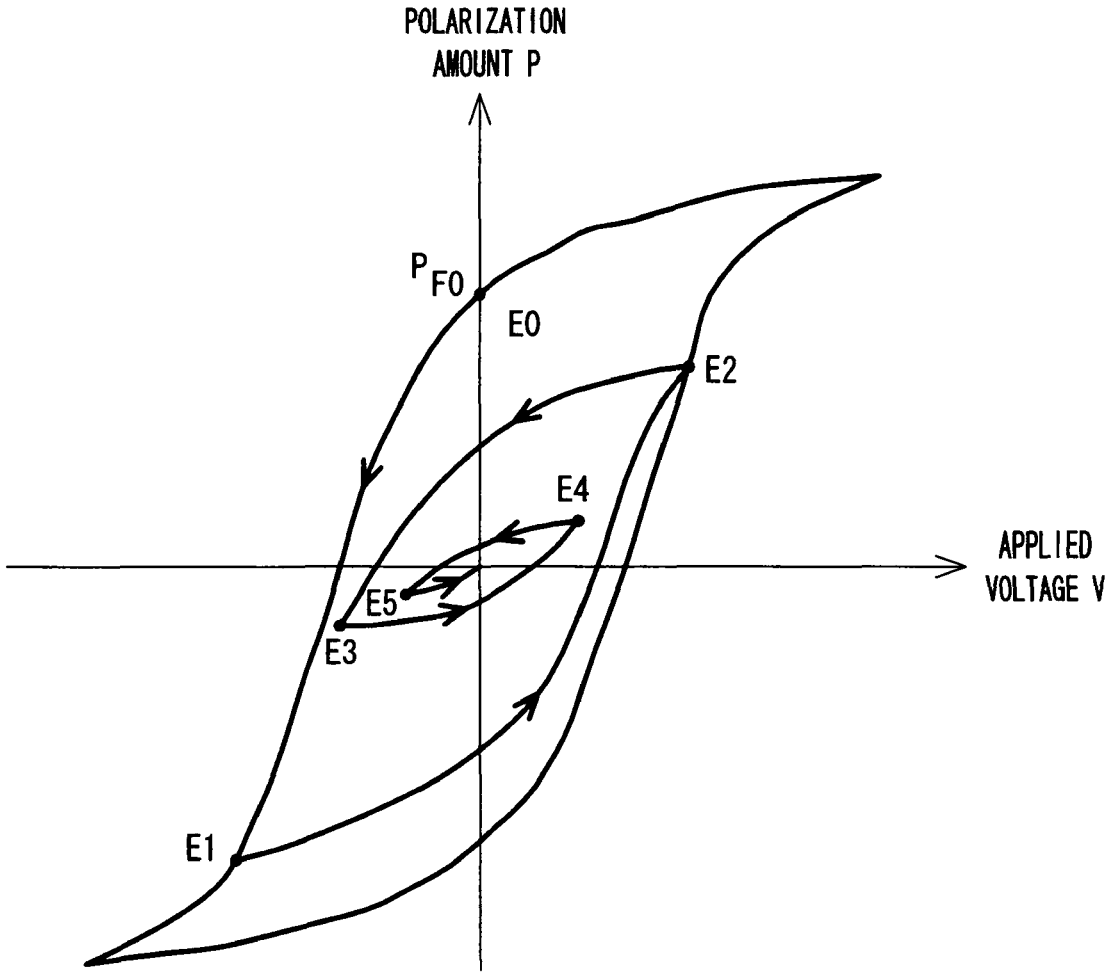
FIG. 8 is a graph showing a process where polarization charges are erased in an erasing step in the method of driving the display device according to the embodiment 1 of the present invention.

FIG. 8 shows a diagram showing a process in which polarization charges remaining inside the light emitting layer of a pixel are erased by the attenuation voltage pulse in which the polarity is alternately reversed between positive and negative in the erasing period 23. The remaining amount of polarization charges at the time of the writing period 111 being completed is assumed to be $P_{E0}$. Then, as described above, when the attenuation voltage pulse in which applied voltage decreases sequentially like $-V_{E1}$, $V_{E2}$, $-V_{E3}$, $V_4$ . . . (where respective voltages are in the relationship of $V_{th}>V_{E1}>V_{E2}>V_{E3}>V_{E4>0}$) is applied, the amount of polarization charges changes gradually so as to be close to 0 like as a position E0->E1->E2->E3->E4->E5 (from E0 to E5), and then the amount of polarization changes reaches 0, as shown in FIG. 8. Only with a single erasing voltage pulse of reverse polarity as conventional examples, polarization charges cannot be erased sufficiently due to remaining charges caused by spontaneous polarization of the ferroelectric, the characteristics of EL element and manufacturing variations and the like, whereby charges are distributed non-uniformly. In particular, as the driving method according to the present embodiment, polarization charges remain significantly when the pulse width becomes about 1 to 3 μsec. The present inventor found that the first polarization charges and second polarization charges of the light emitting layer 16 could be erased without being distributed non-uniformly in a short period by using the attenuation voltage pulse as described above. Thereby, writing into subfields is performed stably, so the display quality is improved. At this time, if there are too many attenuation voltage pulse number, power consumption not contributing to emission increases. Therefore, the attenuation voltage pulse number is preferably 2 or more but 20 or less, and more preferably, 4 or more but 10 or less. Note that although FIG. 8 shows erasing operation starting from a state where polarization voltage is positive, other case of erasing operation starting from a state where polarization voltage is negative is substantially the same. The applied voltage of the attenuation voltage pulse may be attenuated gradually, and there may be an area where a part $V_{EK}$ of the value of the attenuation voltage continuing from $V_{E1}$ to $V_{En}$ (n is an integer) and $V_{Ek+1}$ ($1 \leqq k \leqq n$, k is an integer) is in the relationship of $V_{Ek}>V_{Ek+1}$.

It is preferable that the erasing voltage pulse $P_E$ starts from a voltage of reverse polarity with respect to the polarity of the last pulse of maintaining voltage pulse $P_S$, but it may start from a voltage of the same polarity as the polarity of the last pulse of maintaining voltage pulse $P_S$. However, if phases of the erasing voltage pulse $P_E$ are shifted by data electrodes and polarity of a first wave is reversed, for example, whereby those starting from positive and negative polarities are mixed in the same subfield, non-uniformity erasure of polarization charges is caused and a potential difference is caused between adjacent electrodes, whereby dielectric breakdown and the like is caused between electrodes due to creeping discharge. In particular, dielectric breakdown is easily caused in a dielectric layer using a ferroelectric material. Further, in the case of erasing voltage pulse $P_E$ where only pulse phases are matched and time difference is provided for each data electrode, light emitting period becomes relatively shorter as the erasing period becomes longer, which causes a decrease in brightness. This becomes a prominent problem with respect to an increase in the number of scan lines due to the development of high resolution. In the present embodiment, this problem is solved by applying the erasing voltage pulse $P_E$ of the same phase to all pixels collectively. Further, although there has been described a method in which the erasing voltage pulse $P_E$ is supplied from all data electrodes $X_1$, $X_2$, $X_3 \ldots X_i \ldots X_N$, a method of supplying from all scan electrodes $Y_1, Y_2, Y_3 \ldots Y_j \ldots Y_M$ is also acceptable.

A series of display operation continuing from the writing step (S04), the maintaining step (S05) to the erasing step (S06) is performed to each display data of each subfield 31 to 38 (S07), and the display operation of one field 30 is completed (S08).

Here, responsiveness of the method of driving the display device 10 according to the present embodiment will be explained. For example, a display device of VGA specification (640*480) is assumed, and when a control of the number of gradation $2^8$ is performed to this device with passive matrix driving of the number of gradation $2^8$ and frame frequency of 60 Hz, each pulse width becomes about 1 to 3 μsec. On the other hand, in the light emitting layer 16 of each pixel, when a voltage not less than emission starting voltage $V_{th}$ (electric field strength of about 2 MV/cm) is applied, saturation drift velocity of electron is about $10^7$ cm/s, although it depends on the material of a light emitting layer. If the film thickness of a light emitting layer is assumed to be 1 μm, electrons moves from the interface of one dielectric layer 15 (or 17) to the interface of the other dielectric layer 17 (or 15) with about several 10 μsec, so polarization state is formed sufficiently with the pulse width described above. In addition, as for dielectric layers 15 and 17 interposing the light emitting layer 16, polarization is reversed with about several 10 nsec although depending on the dielectric material, so stable operation is shown with the pulse width described above.

Embodiment 2

Figure 9:
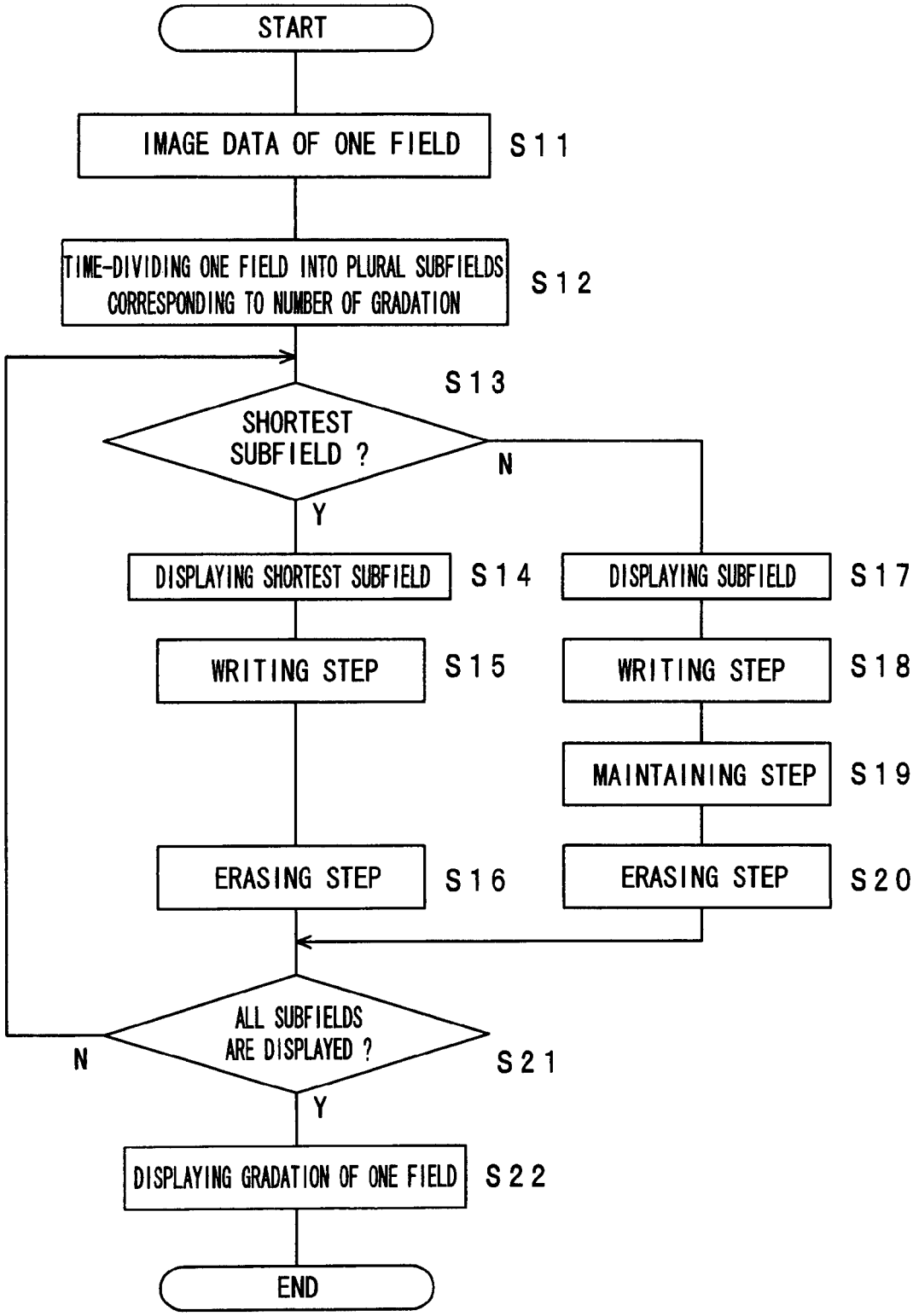
FIG. 9 is a flowchart showing a driving method of a display device according to an embodiment 2 of the present invention.
Figure 10:
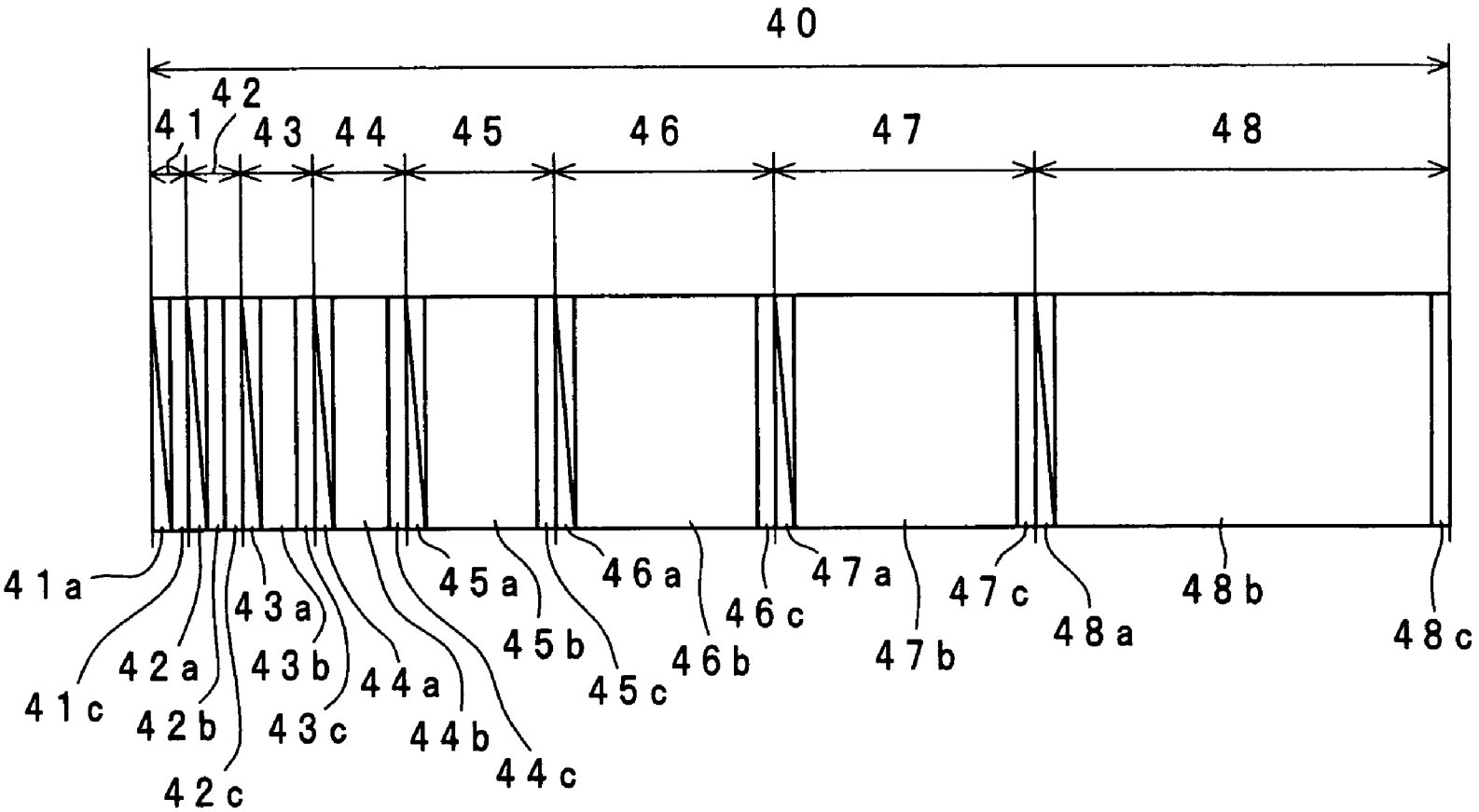
FIG. 10 is a time chart showing respective steps of respective subfields constituting one field in the method of driving the display device according to the embodiment 2 of the present invention.

A driving method of a display device according to an embodiment 2 of the present invention will be explained by using FIG. 9 and FIG. 10. FIG. 9 is a flowchart of a method of driving the display device. FIG. 10 is a diagram showing displaying operation of one field 40 required for displaying one image in $2^8$ gradations in the method of driving the display device. Compared with the method of driving the display device according to the embodiment 1, this method of driving the display device is the same in that one field 40 is divided into eight subfields 41 to 48. It is also the same in that the second subfield 42 through the eighth subfield 48, among the respective subfields, are time-divided into writing periods 42*a* to 48*a* for selecting emissive pixels, maintaining periods 42*b* to 48*b* for emitting selected emissive pixels at a predetermined luminance, and erasing periods 42*c* and 48*c* for erasing states of polarization charges formed inside light emitting layers in all pixels uniformly. On the other hand, the first subfield (time length IT) 41, in which the time length allocated corresponding to the number of gradations is the shortest among the eight subfields, is different in that an maintaining period is not provided and an erasing period 41*c* is provided immediately after a writing period 41*a*. Therefore, the emitting brightness of the first subfield is determined depending on emission obtained in the writing period 41*a*. On the other hand, for the second subfield 42 to the eighth subfield 48 (time length 2T to 128T), displaying operation is completed through writing periods, maintaining periods and erasing periods, as the same as the embodiment 1. Thereby, it is possible to obtain gradation near γ characteristics of human eyes for example by taking large contrast in a low brightness area particularly, while maintaining dynamic range of the brightness. Although in FIG. 10 respective subfields 41 to 48 are arranged in ascending order of the time lengths of maintaining periods 42*b* to 48*b*, the selection of the order of subfields is arbitrary, so it is not limited to this order. On the contrary, unnaturalness in moving images may be easily caused in an arrangement of the order of time lengths in some display devices, so optimization of order appropriate for a display device is desirable.

Compared with the method of driving the display device according to the embodiment 1, this method of driving the display device is the same up to the step of time-dividing one field 40 into n pieces (n=8 in FIG. 10) of subfields 41 to 48 (S12). Then, it is determined whether the time length allocated when displaying each subfield is the shortest subfield 41 (S13). For the shortest subfield 41, the maintaining step is not performed, and only writing step (S15) and the erasing step (S16) are performed. This is the difference. Note that respective steps (S17 to S20) of the subfields 42 to 48 other than the shortest subfield 41, display confirmation of all subfields (S21) and display of one field 40 (S22) are the same as those of the embodiment 1.

Embodiment 3

Figure 11:
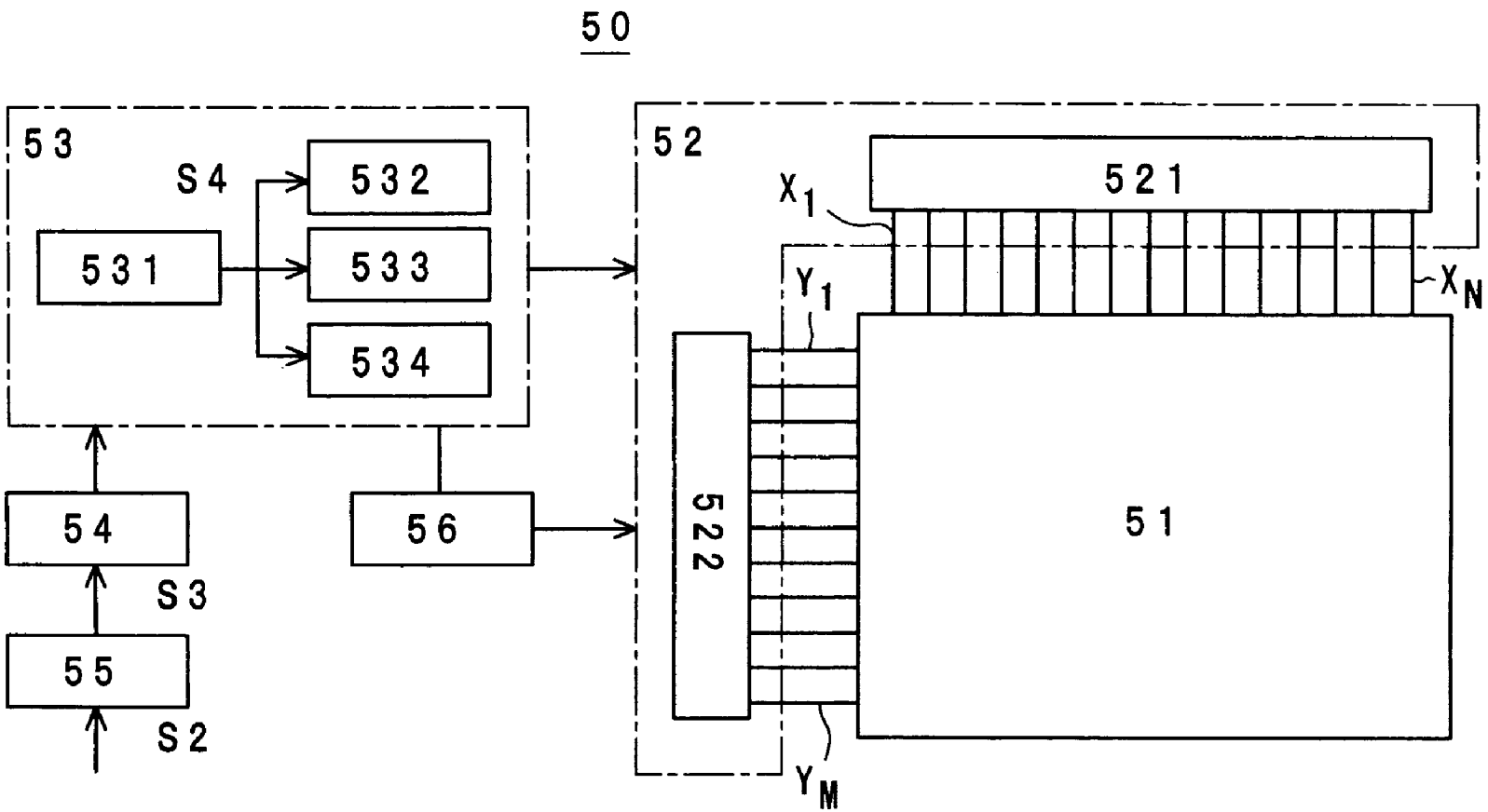
FIG. 11 is a block diagram showing the configuration of a display device according to an embodiment 3 of the present invention.
Figure 12:
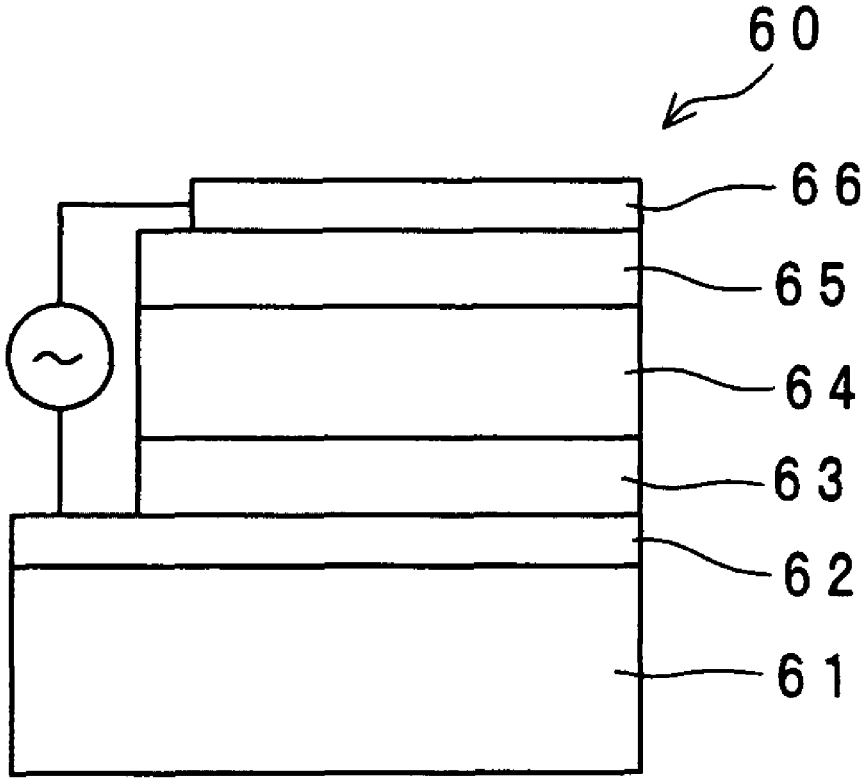
FIG. 12 is a sectional view vertical to the light emitting surface of an EL element of a conventional example.

A display device 50 according to an embodiment 3 of the present invention will be explained by using FIG. 11. FIG. 11 is a block diagram showing the configuration of the display device 50. Compared with the display device 10 according to the embodiment 1, the display device 50 is different in that an A/D converting unit 55, a frame memory 54 and a driving power source 56 are further included.

Next, displaying operation of the display device 50 will be explained. A video signal S2 of image data inputted is converted into a digital video signal S3 of n bit by the A/D converting unit 55, and is stored on the frame memory 54. Then, in the controlling unit 53, a subfield dividing unit 531 first takes out a signal of one bit corresponding to the weight of gradation of the video signal S3, and outputs video signal S4 of each subfield sequentially. Based on these video signals S4, data of modulation voltage pulse $P_M$ is first transmitted from a writing pulse supplying unit 532 to a data electrode driving circuit 521. The data electrode driving circuit 521 applies a predetermined modulation voltage $V_M$ or $-V_M$ corresponding to emission and non-emission to respective data electrodes $X_1$ to $X_N$. On the other hand, scan electrodes $Y_1$ to $Y_M$ are scanned in the linear order, and in a period from scan starting timings to scan end timings of the respective scan electrodes $Y_1$ to $Y_M$, data of writing voltage pulse $P_W$ is transmitted from the writing pulse supplying unit 532 to the scan electrode driving circuit 522. A predetermined writing voltage $-V_W$ is applied from the scan electrode driving circuit 522 to the scan electrodes $Y_1$ to $Y_M$. By performing this for one screen, writing is performed to all pixels. Then, the maintaining pulse supplying unit 533 generates maintaining voltage pulse $P_S$ at the same timing to all pixels of the screen, and applies a predetermined voltage $V_S$ or $-V_S$ not more than the emission starting voltage $V_{th}$ from the data electrode driving circuit 521 to the scan electrodes. The same as the driving method of the display device according to the embodiment 1, by supplying the maintaining voltage pulse $P_S$ having reverse polarity with respect to the polarity of the data electrodes $X_1$ to $X_N$ and the scan electrodes $Y_1$ to $Y_M$ in the writing step. Thus, the maintaining voltage pulse $P_S$ continuously applied to polarization charges caused inside the light emitting layers of the pixels becomes forward bias, whereby emission is maintained intermittently in emissive pixels. Then, the erasing pulse supplying unit 534 generates the erasing voltage pulse $P_E$ to all pixels of the screen, and applies a predetermined voltage, in which the applying voltage level is lowered gradually, from the data electrode driving circuit 521 to the scan electrodes. This cycle is repeated for each subfield. Although the above-described writing method shows a case where the writing voltage pulse $P_W$ is a negative voltage pulse, a method in which the writing voltage pulse $P_W$ is a positive voltage pulse, or a method in which the positive voltage pulse and negative voltage pulse are switched alternately by field or by subfield is acceptable. In such a case, the voltage polarity of the modulation voltage pulse $P_M$ corresponding to emissive pixel/non-emissive pixel may be changed according to the voltage polarity of the writing voltage pulse $P_W$. Further, although, in the writing method described above, the output reference voltages of the modulation voltage pulse $P_M$ to data electrodes have two values of $V_M$ and $-V_M$ which are positive and negative same voltage, they may be different voltages or ones in which one condition is GND potential. Moreover, although there has been described a method in which the maintaining voltage pulse $P_S$ and the erasing voltage pulse $P_E$ are supplied from all data electrodes $X_1$ to $X_N$, a method in which they are supplied from all scan electrodes $Y_1$ to $Y_M$ is acceptable.

Note that the respective embodiments described above merely show examples, so the configuration of the present invention is not limited to the configurations of the respective embodiments.

As described above, the present invention is described in detail referring to preferred embodiments. However, the present invention is not limited to them. It is obvious for those skilled in the art that various preferable variations and modifications are possible within the technical scope of the present invention described in the scope of claims.

The display devices and the methods of driving a display device according to the present invention are useful as display devices such as televisions in particular.

The invention claimed is:

1. A display device comprising:

a display unit comprising:

a plurality of scan electrodes extending along a first direction and arranged parallel to each other;

a plurality of data electrodes extending along a second direction crossing the scan electrodes and arranged parallel to each other; and a plurality of pixels, each pixel at which a pair of the scan electrode and the data electrode cross each other, wherein each pixel has a light emitting layer and a dielectric layer interposed between the scan electrode and the data electrode;

a writing pulse supplying unit configured to select pixels for emitting light, and supply a writing voltage pulse train so as to apply a voltage not less than emission starting voltage to light emitting layers of the selected pixels;

maintaining pulse supplying unit configured to supply maintaining voltage pulse train; and an erasing pulse supplying unit configured to supply an attenuation voltage pulse train, to the light emitting layer of each pixel, wherein:

the attenuation voltage pulse train starts at a voltage not more than emission starting voltage at which the light emitting layer starts light emission, and starts from a voltage of reverse polarity with respect to a polarity of a last voltage pulse of the maintaining voltage pulse train, polarity of the attenuation voltage pulse train is alternately reversed between positive and negative, and absolute voltage values of the attenuation voltage pulse train decreases gradually so that a subsequent pulse has a smaller absolute voltage value than a previous pulse, and the light emitting layer performs self-electroluminescence emission when a voltage not less than the emission starting voltage is applied to the light emitting layer.

2. The display device according to claim 1, wherein the dielectric layer is made of a ferroelectric material.

3. The display device according to claim 1, wherein the dielectric layer includes a first dielectric layer and a second dielectric layer, and wherein, in the pixel of the display unit, the light emitting layer and the first and second dielectric layers interposing the light emitting layer are interposed between the scan electrode and the data electrode.

4. The display device according to claim 3, wherein at least one dielectric layer of the first and second dielectric layers is made of a ferroelectric material.

5. The display device according to claim 1, further comprising a driving unit configured to drive the display unit by applying a voltage between the scan electrode and the data electrode.

6. The display device according to claim 1, further comprising a subfield dividing unit configured to time-divide one field to be displayed by light emission of selected pixels among all of the pixels into a plurality of subfields corresponding to the number of gradation to be displayed, wherein the erasing pulse supplying unit supplies the attenuation voltage pulse train to the light emitting layer of each of the pixels for each of the subfields.

7. The display device according to claim 6, wherein the writing pulse supplying unit supplies writing voltage pulse train of not more than the emission starting voltage via one of the scan electrodes to the light emitting layer of the pixel connected with the scan electrode for all of the scan electrodes in a linear order for each of the subfields, and supplies modulation voltage pulse train in which a differential voltage with a voltage of the writing voltage pulse train is not less than the emission starting voltage via the data electrode selected among all of the data electrodes to the light emitting layer of the pixel connected with the selected data electrode for each of the subfields.

8. The display device according to claim 7, wherein the maintaining pulse supplying unit is configured to supply, in at least one of the subfields, the maintaining voltage pulse train which starts from a predetermined voltage not more than the emission starting voltage and of which polarity is alternately reversed between positive and negative, with a predetermined pulse number corresponding to the number of gradations allocated to the subfield, to all of the pixels.

9. The display device according to claim 6, wherein the subfield dividing unit time-divides the one field into n pieces of subfields including a first subfield having a smallest pulse number corresponding to a lowest brightness to be allocated, and a second subfield to an nth subfield to which respective pulse numbers in which ratio to the smallest pulse number is $2^i$ (i=1~n−1) are allocated respectively, according to the number of gradations $2^n$ to be displayed.

10. The display device according to claim 1, wherein the dielectric layer has at least a part having a remaining polarization amount of not less than 3μC/cm$^2$.

11. The display device according to claim 1, wherein the scan electrode is a transparent electrode.

12. A method of driving a display device including, a display unit having: a plurality of scan electrodes extending along a first direction and arranged parallel to each other; a plurality of data electrodes extending along a second direction crossing the scan electrodes and arranged parallel to each other; and a plurality of pixels, each pixel at which a pair of the scan electrode and the data electrode cross each other, each pixel having a light emitting layer and a dielectric layer interposed between the scan electrode and the data electrode from a direction vertical to a face, the method comprising:

selecting pixels for emitting light, and supplying a writing voltage pulse train so as to apply a voltage not less than emission starting voltage to light emitting layers of the selected pixels;

maintaining step for supplying maintaining voltage pulse train; and erasing step for applying an attenuation voltage pulse train, to the light emitting layer of each pixel, wherein:

the attenuation voltage pulse train starts at a voltage not more than emission starting voltage at which the light emitting layer starts light emission, and starts from a voltage of reverse polarity with respect to a polarity of a last voltage pulse of the maintaining voltage pulse train, polarity of the attenuation voltage pulse train is alternately reversed between positive and negative, and absolute voltage values of the attenuation voltage pulse train decreases gradually so that a subsequent pulse has a smaller absolute voltage value than a previous pulse, and the light emitting layer performs self-electroluminescence emission when a voltage not less than the emission starting voltage is applied to the light emitting layer.

13. The method of driving the display device according to claim 12, wherein at least one dielectric layer of the dielectric layers is made of a ferroelectric material, and wherein spontaneous polarization of the dielectric layer is erased by the attenuation voltage pulse train in the erasing step.

14. The method of driving the display device according to claim 12, further comprising time-dividing one filed to be displayed by emission of a selected pixel among all of the pixels into a plurality of subfields corresponding to the number of gradations to be displayed, wherein the erasing step is performed for each of the subfields.

15. The method of driving the display device according to claim 14, wherein the writing step supplies writing voltage pulse train of not more than the emission starting voltage via one of the scan electrodes to the light emitting layer of the pixel connected with the scan electrode for all of the scan electrodes in a linear order for each of the subfields, and supplies modulation voltage pulse train in which a differential voltage with a voltage of the writing voltage pulse train is not less than the emission starting voltage via a data electrode selected among all of the data electrodes to the light emitting layer of the pixel connected with the selected data electrode for each of the subfields.

16. The method of driving the display device according to claim 15, wherein the maintaining step supplies, in at least one of the subfields, the maintaining voltage pulse train which starts from a predetermined voltage of not more than the emission starting voltage and in which polarity is alternately reversed between positive and negative, with a predetermined pulse number corresponding to the number of gradations allocated to the subfield, to all of the pixels.

17. The method of driving the display device according to claim 14, wherein in the course of the time-dividing step, brightness allocated to each subfield is time-divided into the plurality of subfields corresponding to a pulse number applied to the light emitting layer.

18. The method of driving the display device according to claim 14, wherein in the course of the time-dividing step, the one field is time-divided into n pieces of subfields including a first subfield having a smallest pulse number applied to the light emitting layer corresponding to a lowest brightness to be allocated, and a second subfield to an nth subfield to which respective pulse numbers in which ratio to the smallest pulse number is $2^i$ (i=1~n−1) are applied respectively, according to the number of gradations $2^n$ to be displayed.

19. The method of driving the display device according to claim 14, wherein gradation displayed in the selected pixels in the one field is controlled by selecting a combination of subfields where the selected pixels are caused to emit light among the plurality of subfields.

20. The method of driving the display device according to claim 16, wherein the shortest subfield among the plurality of subfields does not include the maintaining step.

* * * * *